US012352045B2

(12) United States Patent
Stretch et al.

(10) Patent No.: US 12,352,045 B2
(45) Date of Patent: Jul. 8, 2025

(54) MODULAR SLAB, SLAB SYSTEM, PILES AND METHODS OF USE THEREOF

(71) Applicant: Junction7 Limited, Arrowtown (NZ)

(72) Inventors: David John Stretch, Arrowtown (NZ); Warrick Weber, Arrowtown (NZ)

(73) Assignee: JUNCTION7 LIMITED, Arrowtown (NZ)

( * ) Notice: Subject to any disclaimer, the term of this patent is extended or adjusted under 35 U.S.C. 154(b) by 0 days.

(21) Appl. No.: 18/396,434

(22) Filed: Dec. 26, 2023

(65) Prior Publication Data

US 2024/0125120 A1 Apr. 18, 2024

Related U.S. Application Data

(63) Continuation of application No. 17/609,904, filed as application No. PCT/NZ2020/050043 on May 7, 2020, now Pat. No. 11,891,802.

(30) Foreign Application Priority Data

May 9, 2019 (NZ) ..... 753353

(51) Int. Cl.

| | |
|---|---|
| ***E04B 5/02*** | (2006.01) |
| ***E02D 27/01*** | (2006.01) |
| ***E04B 5/04*** | (2006.01) |
| *E01C 3/00* | (2006.01) |
| *E01C 5/10* | (2006.01) |

(Continued)

(52) U.S. Cl.

CPC ..... *E04B 5/023* (2013.01); *E02D 27/016* (2013.01); *E04B 5/04* (2013.01); *E01C 3/006* (2013.01); *E01C 5/10* (2013.01); *E01D 19/125* (2013.01); *E01D 2101/28* (2013.01); *E02D 27/16* (2013.01); *E02D 27/34* (2013.01); *E02D 2300/002* (2013.01); *E02D 2600/20* (2013.01); *E04B 2103/02* (2013.01)

(58) Field of Classification Search

CPC ..... E04B 5/023; E04B 5/04; E04B 2103/02; E02D 27/016; E02D 27/16; E02D 27/34; E02D 2300/002; E02D 2600/20; E01C 3/006; E01C 5/10; E01C 19/125; E01C 2101/28

See application file for complete search history.

(56) References Cited

U.S. PATENT DOCUMENTS

| | | | |
|---|---|---|---|
| 5,255,996 | A | 10/1993 | Kiat et al. |
| 5,863,148 | A | 1/1999 | Shivaram |

(Continued)

FOREIGN PATENT DOCUMENTS

| | | | |
|---|---|---|---|
| AU | 2012101774 | A4 | 3/2013 |
| KR | 100840376 | B1 | 6/2008 |

(Continued)

*Primary Examiner* — Mark R Wendell

(74) *Attorney, Agent, or Firm* — Holzer Patel Drennan

(57) ABSTRACT

A modular slab, slab system, piles and methods of use thereof are described along with specific applications and methods of manufacture. The slab or slab system may be pre-insulated and pre-finished before being assembled on site. The slab system may be advantageous to use as a replacement for traditional in-situ poured building foundations. The slab system may also have uses in other fields such as for floors, roads, bridges, pavements/side walks and other civil and structural applications.

17 Claims, 20 Drawing Sheets

(51) Int. Cl.

| | |
|---|---|
| *E01D 19/12* | (2006.01) |
| *E01D 101/28* | (2006.01) |
| *E02D 27/16* | (2006.01) |
| *E02D 27/34* | (2006.01) |

(56) References Cited

U.S. PATENT DOCUMENTS

| | | | | |
|---|---|---|---|---|
| 2003/0108388 | A1 | 6/2003 | Smith | |
| 2011/0296791 | A1 | 12/2011 | Finn | |
| 2014/0270947 | A1 | 9/2014 | Ulislam | |
| 2016/0376762 | A1* | 12/2016 | Wong | E02D 7/00 405/210 |
| 2018/0283001 | A1 | 10/2018 | Erwin et al. | |
| 2020/0095744 | A1* | 3/2020 | Hedberg | E02B 17/00 |

FOREIGN PATENT DOCUMENTS

| | | | |
|---|---|---|---|
| KR | 100840377 | B1 | 6/2008 |
| KR | 20130010220 | A | 1/2013 |
| KR | 101410443 | B1 | 6/2014 |

* cited by examiner

MODULAR SLAB, SLAB SYSTEM, PILES AND METHODS OF USE THEREOF

RELATED APPLICATIONS

This application is a continuation of U.S. patent application Ser. No. 17/609,904, filed on Nov. 9, 2021, the entirety of which is incorporated herein by reference.

This application derives priority from New Zealand patent application number 753353 incorporated herein by reference.

TECHNICAL DESCRIPTION

A modular slab, slab system, piles and methods of use thereof are described along with specific applications and methods of manufacture. The slab or slab system may be pre-insulated and pre-finished before being assembled on site. The slab system may be advantageous to use as a replacement for traditional in-situ poured building foundations. The slab system may also have uses in other fields such as for floors, roads, bridges, pavements/side walks and other civil and structural applications.

BACKGROUND

Precast, modular flooring slabs date to the late 1800's.

Precast slabs having arch features on the underside which are strengthened using post-tensioned members in transverse and longitudinal directions, and which supply the support for the slab are also well known.

Slab connecting features for joining the slabs are known.

Slabs manufactured using multiple blocks that are post-tensioned by rods running through the blocks in multiple directions to form a rigid flat structure are known.

A slab constructed from multiple slab sections that are pre-stressed longitudinally and together with supporting beams and other slab sections that are post-tensioned using a cable system during installation are known.

A foundation and floor system comprising ground engaging foundation pads that are clamped together with bolts, on which are mounted perimeter wall sections and spacer posts that support multiple prefinished floor panels is known.

The use of foamed polystyrene elements for load bearing purposes in a dry-laid floor, where the polystyrene members are laid on and over a number of parallel, spaced beams and an upper floor layer placed on top of the polystyrene elements such that the polystyrene elements act as a thermal break between the beams and the flooring is known.

The above art pre-cast products and system are however not widely used. The traditional method of pouring concrete in-situ into timber boxing is the most common method of constructing foundations. This traditional method has cartage costs for the materials used, is slow and inherently lacks tight tolerances. Achieving a desired level of stressing and tensioning is difficult in-situ as is the process of implementing a thermal break. Pours of this nature are also done onto a substrate such as the ground or gravel and not above ground level for example to form a concrete slab foundation over piles. Because of this, use of concrete slabs without retaining walls tends to be restricted to generally flat sites.

The art noted above does not address a need within the construction market for a fast and effective foundation and floor system that can be installed quickly and with high tolerances and which overcomes many of the disadvantages of traditional in-situ pouring.

Further aspects and advantages of the modular slab, slab system, piles and methods of use thereof will become apparent from the ensuing description that is given by way of example only.

SUMMARY

In a first aspect, there is provided a modular precast concrete slab with plinths extending from the slab that are configured to complement and seat into recesses within at least one pile on which the slab is placed.

In a second aspect, there is provided a modular precast concrete slab with plinths extending from the slab, the plinths having recesses, the recesses being configured to complement and receive piles or parts thereof onto which the slab is placed.

The slab as noted above may further comprise an insulating layer located between each plinth and pile, the insulating layer configured to provide a thermal break between the pile and plinth.

In a third aspect there is provided a pile comprising an elongated shape and configured to at one end be recessed at least partly into the ground and at the opposing end, comprising a recess, the recess size and shape corresponding to a plinth shape, the plinth extending from a pre-cast concrete slab and the pile, acting to locate and retain the pre-cast slab and plinth thereon in place relative to the pile.

In a fourth aspect there is provided a pile comprising an elongated shape and configured at one end to fit at least partly into the ground and at the opposing end, comprising a shape that is configured to be received into a recess in a plinth, the recess size and shape corresponding to a pile end shape, the plinth extending from a pre-cast concrete slab and the plinth, acting to locate and retain the pre-cast slab and plinth thereon in place relative to the pile.

In a fifth aspect, there is provided a modular precast concrete slab system comprising a plurality of precast concrete slabs and piles, the slabs having plinths extending from the slab, the slab plinths configured to be located within a recess on at least one pile or part thereof and the slabs being linked together to form the slab system.

In a sixth aspect, there is provided a modular precast concrete slab system comprising a plurality of precast concrete slabs and piles, the slabs having plinths extending from the slab, the slab plinths configured to with a recess that is configured to receive on at least one pile or part thereof, and the slabs being linked together to form the slab system.

In a seventh aspect, there is provided a building foundation manufactured from the slab system substantially as described above.

In a eighth aspect, there is provided a floor manufactured from the slab system substantially as described above.

In a ninth aspect, there is provided a road or section of road manufactured from the slab system substantially as described above.

In a tenth aspect, there is provided a bridge or section of bridge manufactured from the slab system substantially as described above.

In an eleventh aspect, there is provided a pavement/side walk/pathway manufactured from the slab system substantially as described above.

In a twelfth aspect, there is provided an earth retaining structure manufactured from the slab system substantially as described above.

BRIEF DESCRIPTION OF THE DRAWINGS

Further aspects of the modular pre-cast slab, pile and slab system and method of manufacture will become apparent from the following description that is given by way of example only and with reference to the accompanying drawings in which.

DETAILED DESCRIPTION

Figure 1:
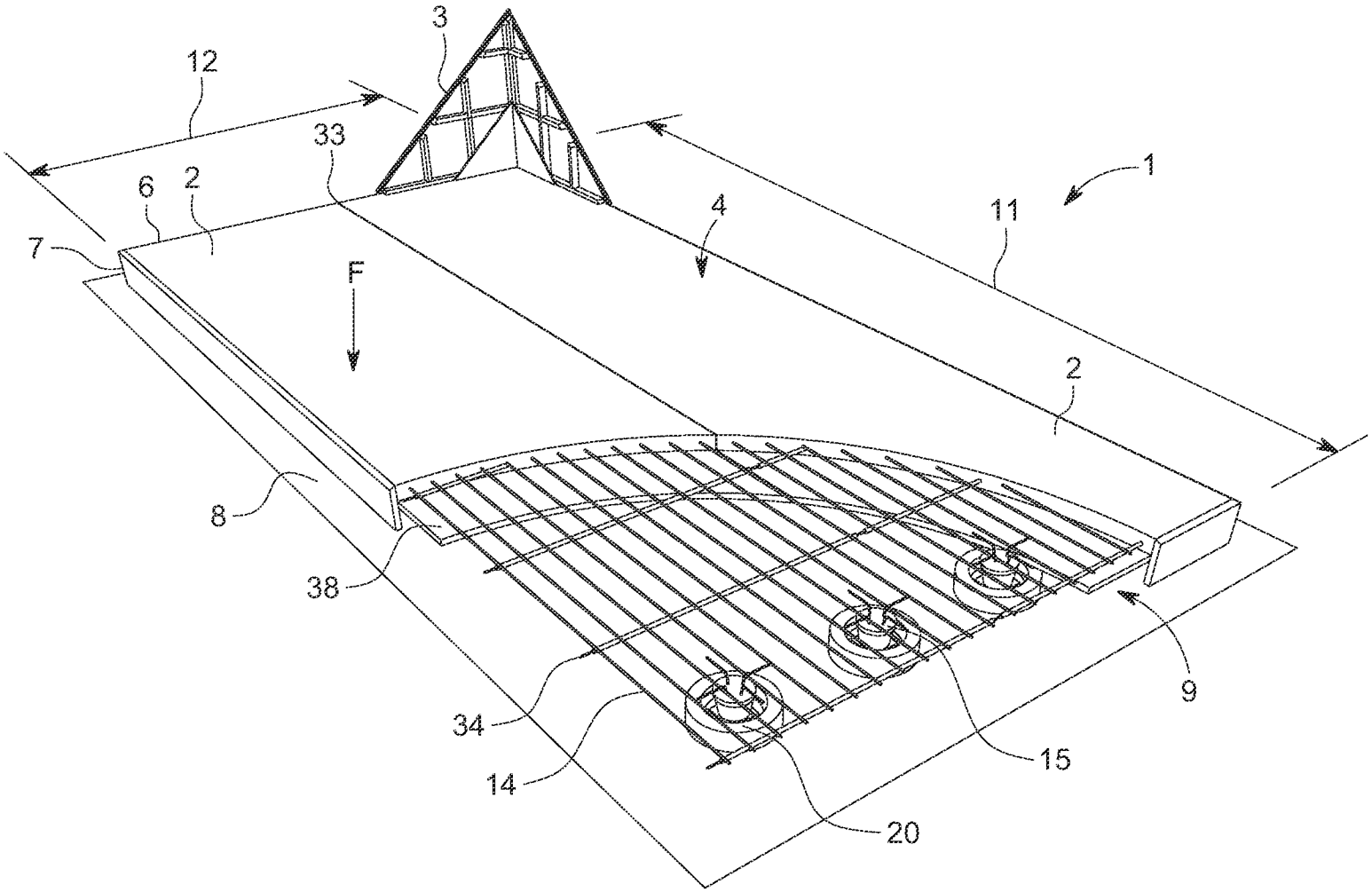
FIG. 1 illustrates a perspective cutaway section view of one embodiment a slab system as viewed from above.
Figure 2:
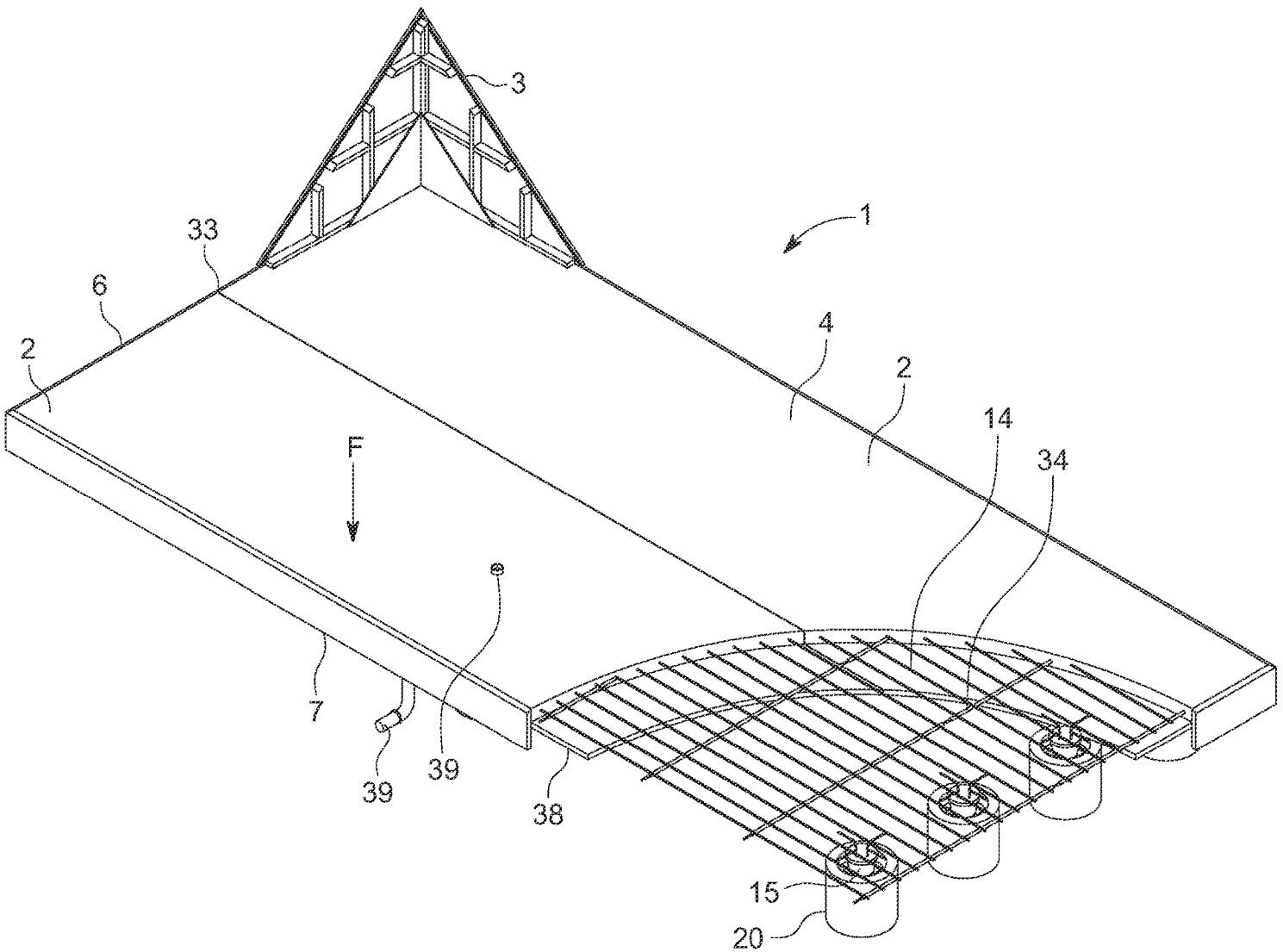
FIG. 2 illustrates the perspective cutaway section view above with a substrate darkened layer removed for clarity.
Figure 3:
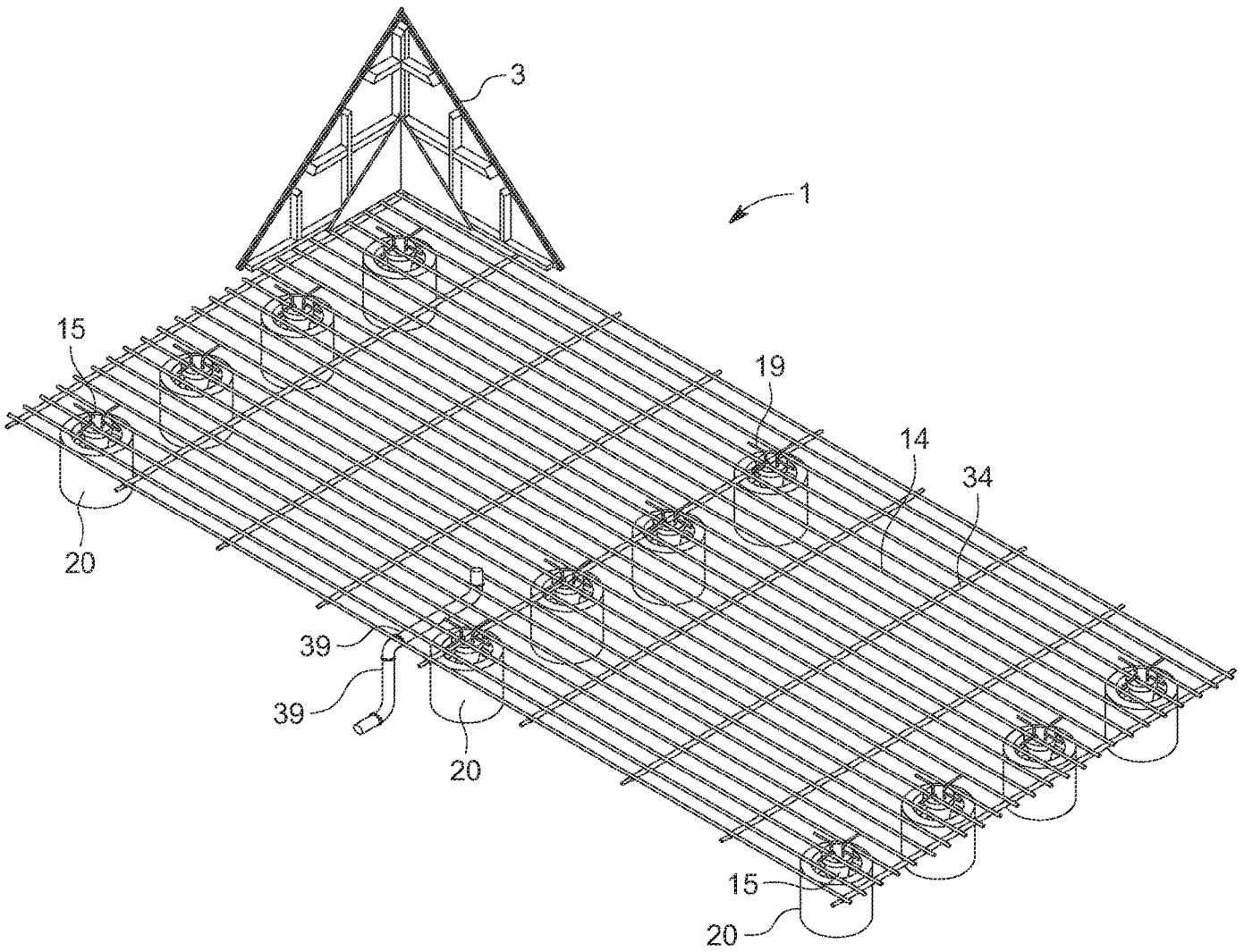
FIG. 3 illustrates the above perspective cutaway section view with the slab concrete layer removed to show internal slab/slab system details.
Figure 4:
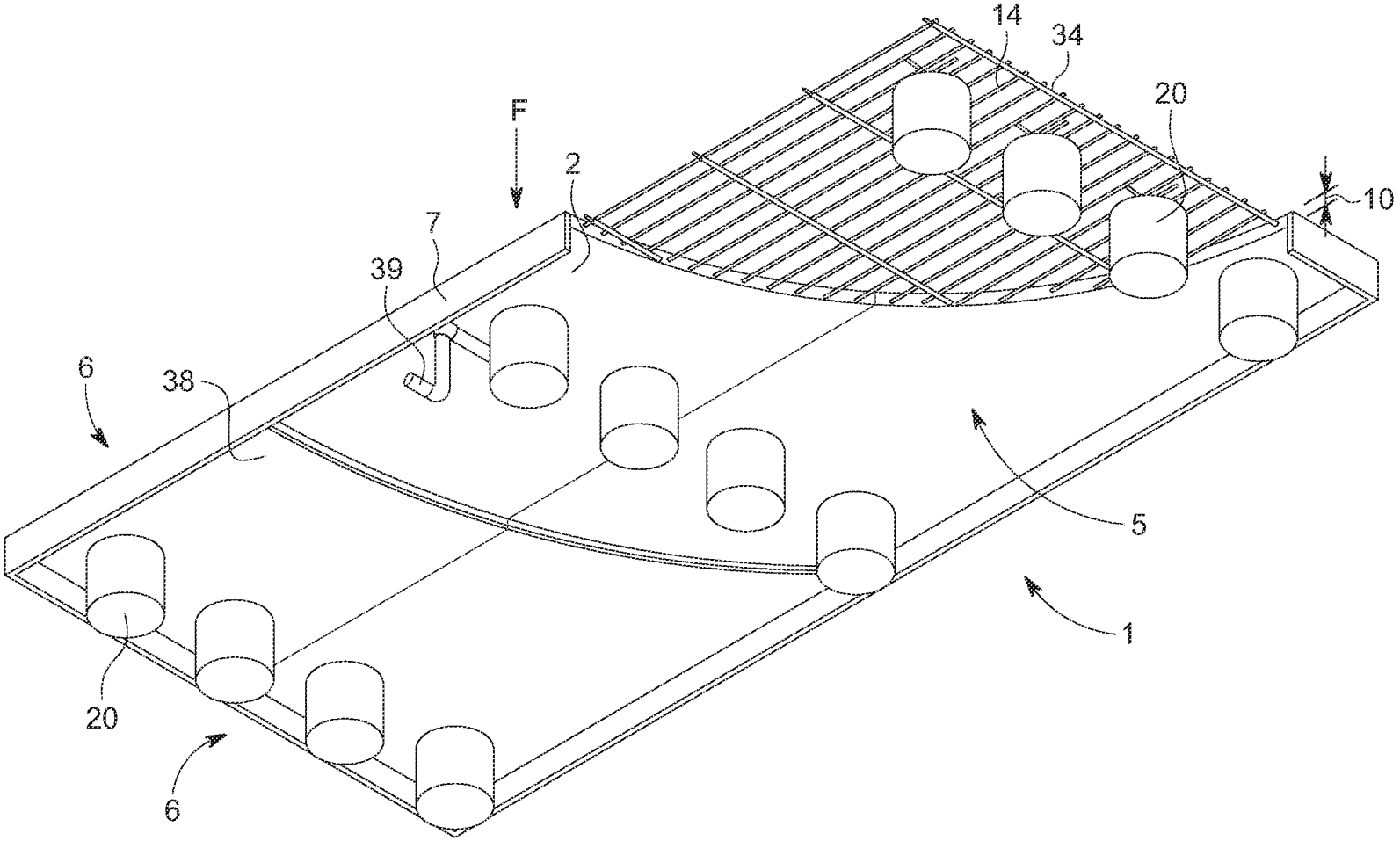
FIG. 4 illustrates the perspective cutaway section view of FIG. 2 as viewed from below.
Figure 5:
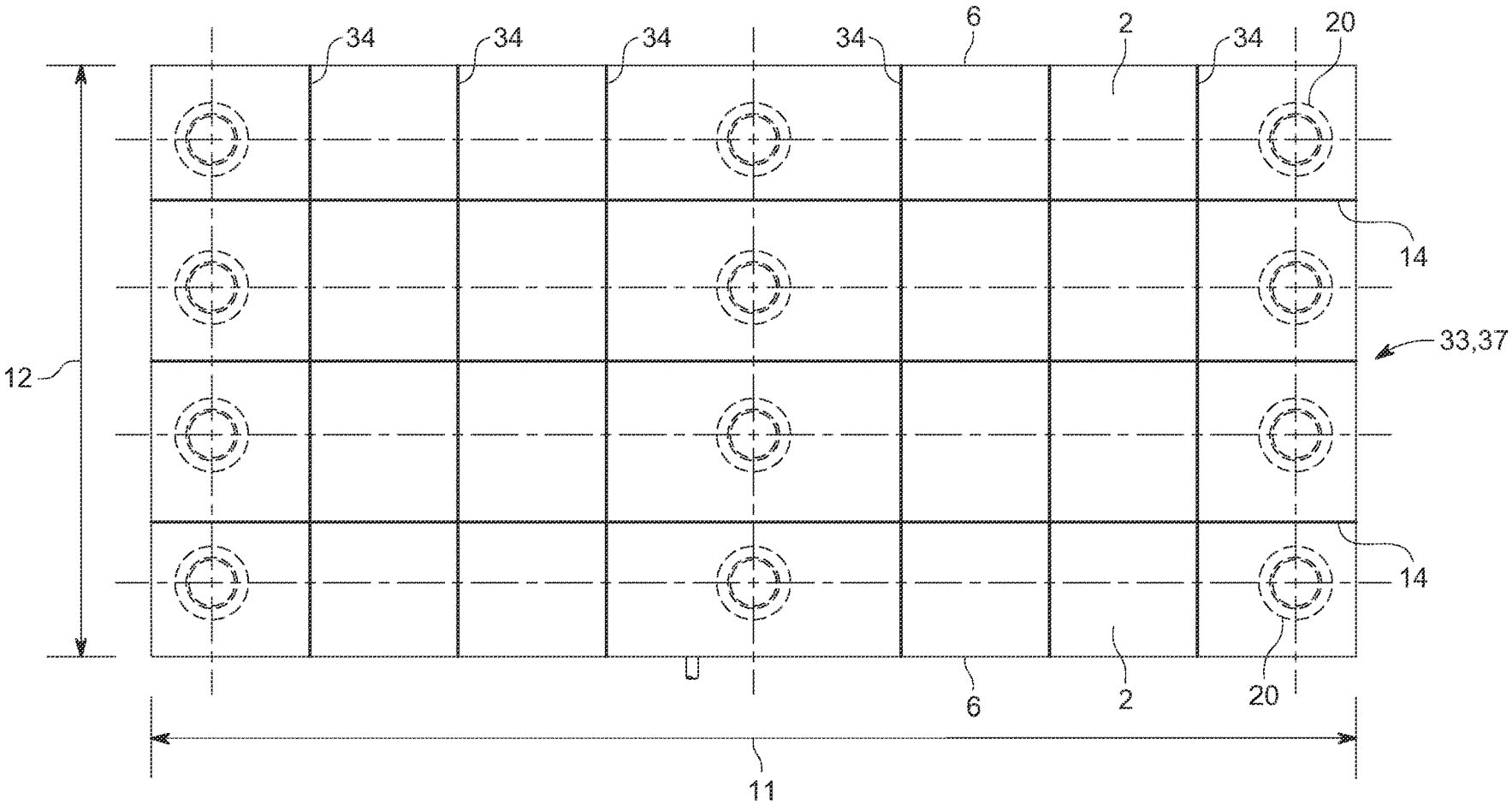
FIG. 5 illustrates a plan view of the slab system of the above Figures showing the internal structure of the slab system.
Figure 6:
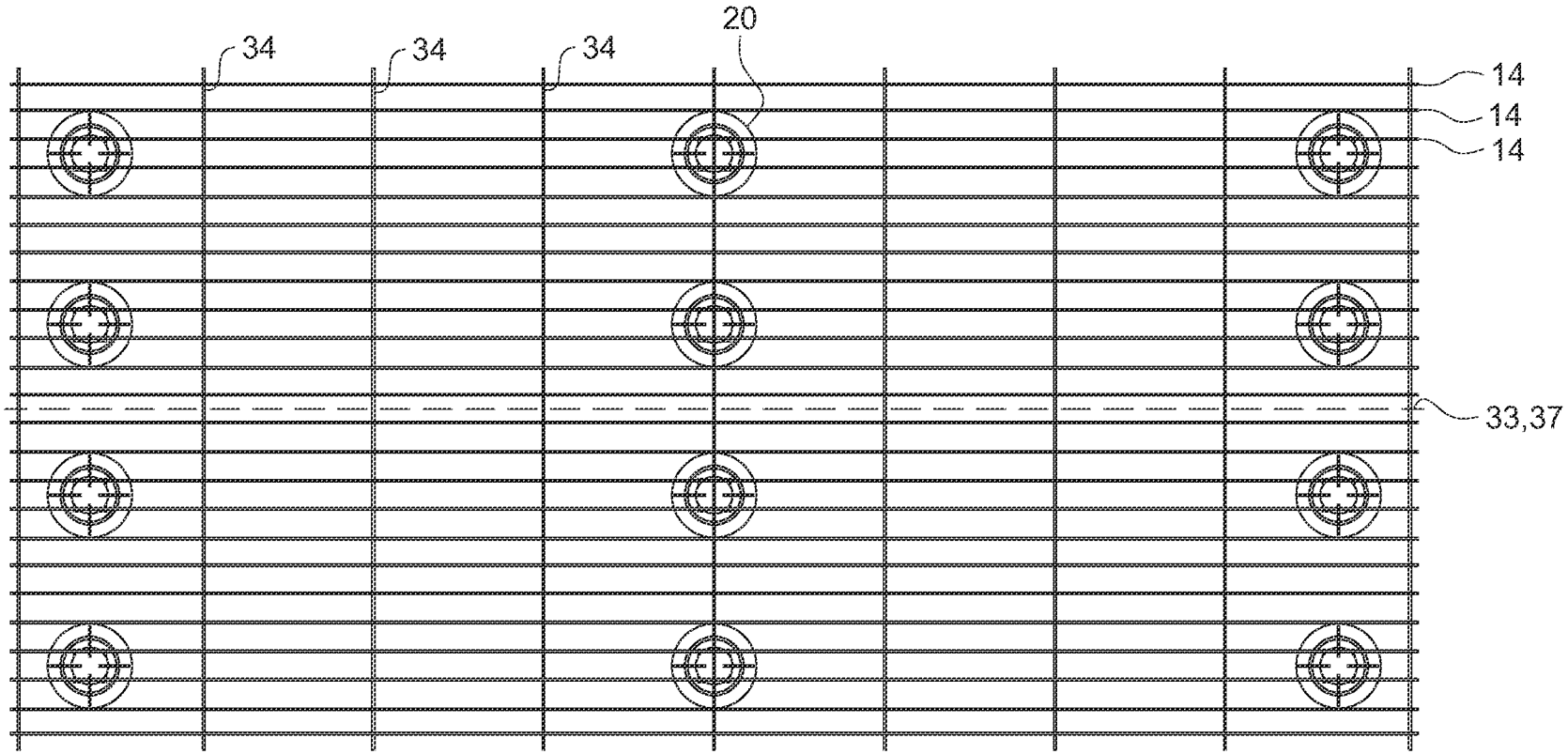
FIG. 6 illustrates a plan view of the slab system of the above Figures showing the internal reinforcing structure of the slab system.
Figure 7:
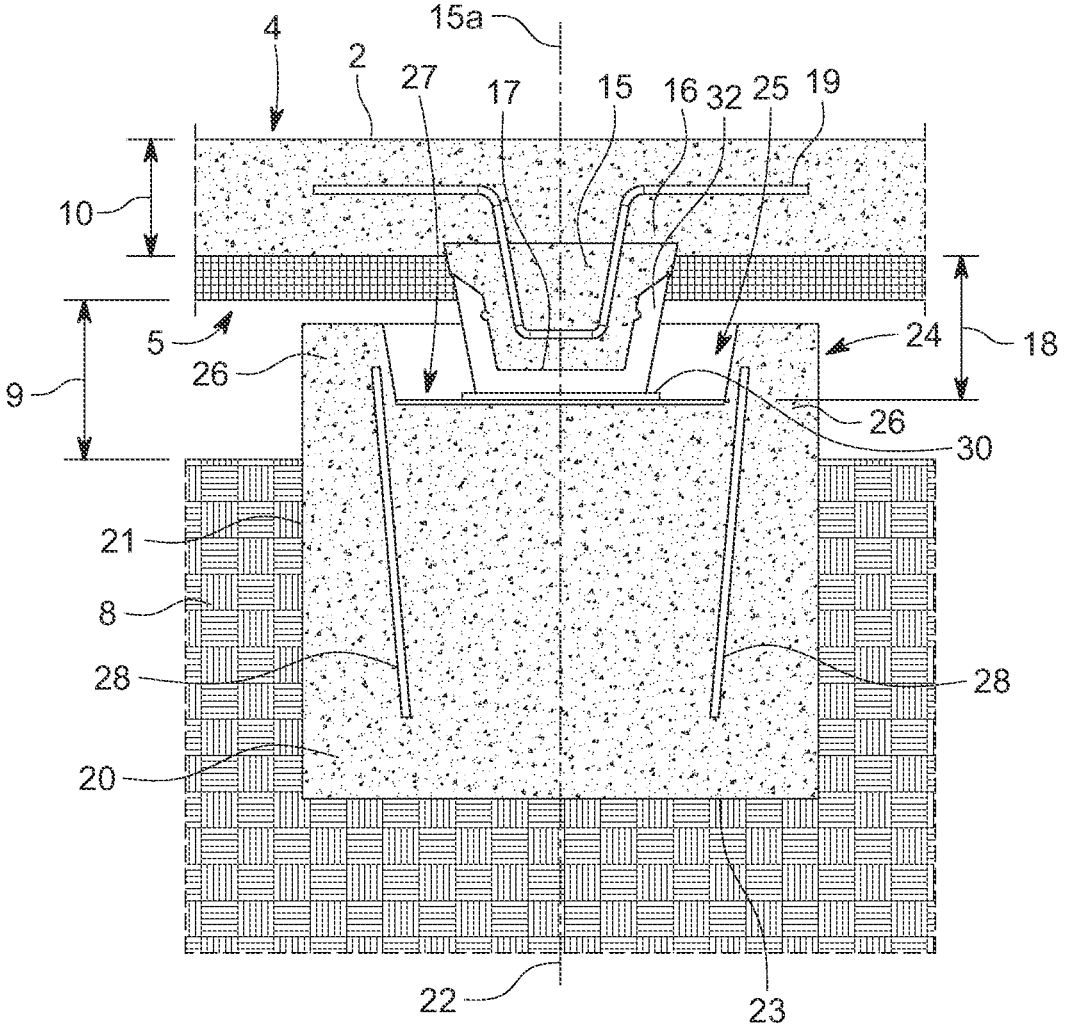
FIG. 7 illustrates a side cross-section view of the slab, plinth feature and pile aligned together in the above embodiment.
Figure 8:
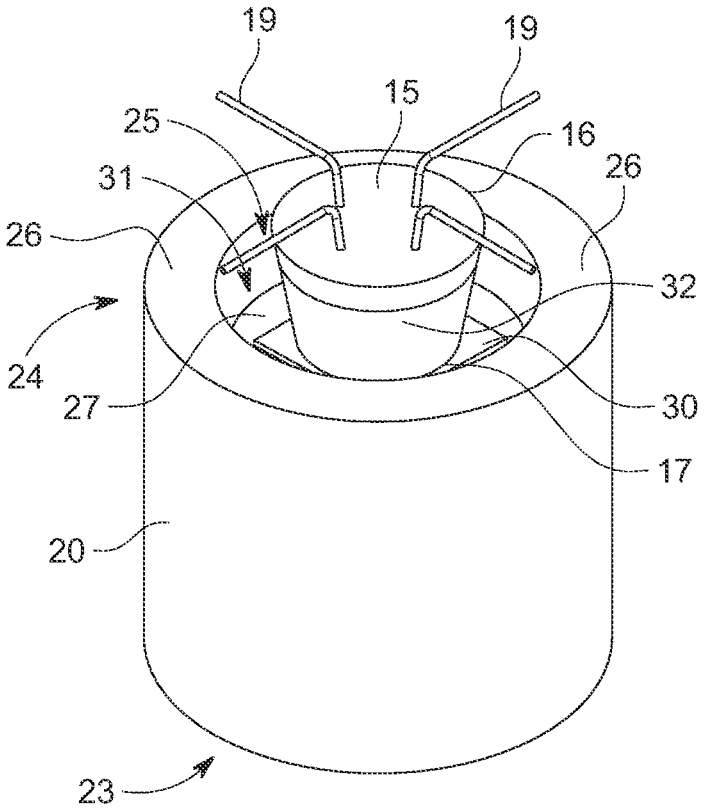
FIG. 8 illustrates a perspective view of the plinth and pile when positioned together.
Figure 9:
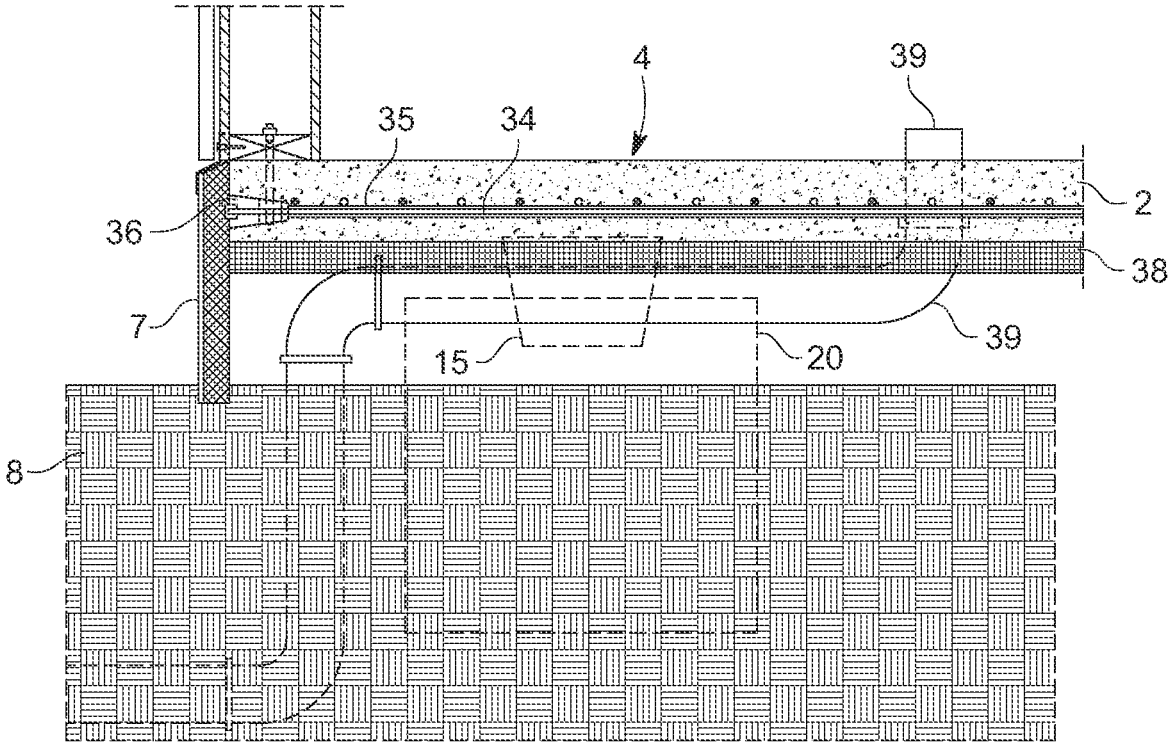
FIG. 9 illustrates a side cross-section view of the above slab system embodiment about a strand and service connection.
Figure 10:
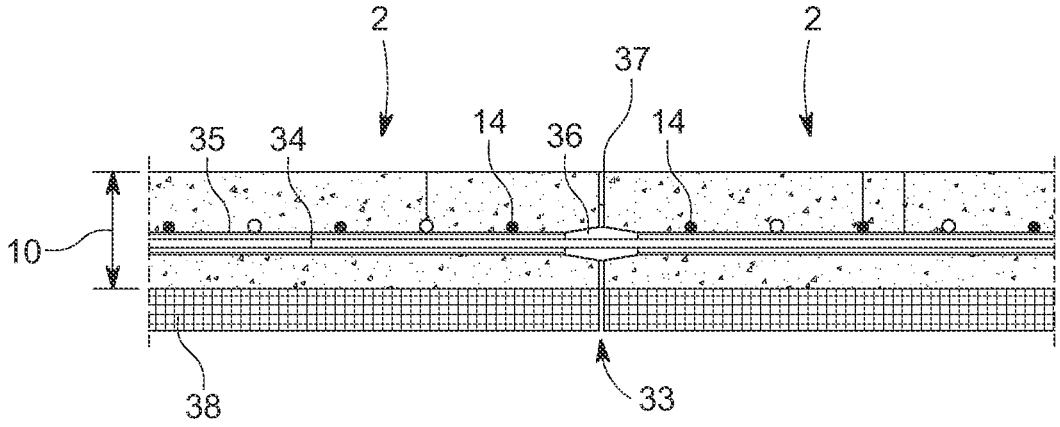
FIG. 10 illustrates a detail side cross-section view of a strand.
Figure 11:
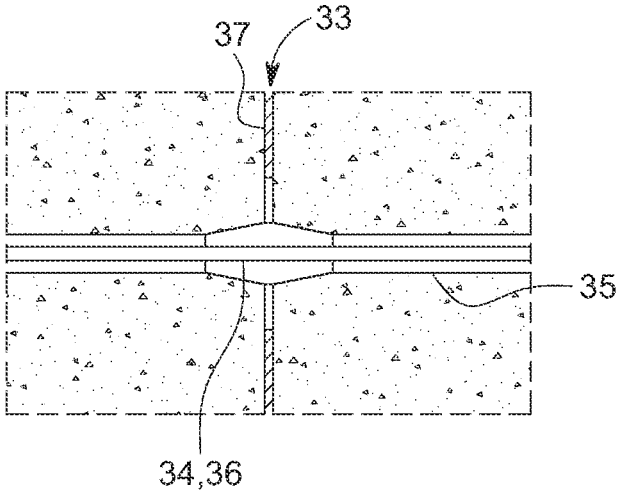
FIG. 11 illustrates a detail plan cross-section view of a strand.
Figure 12:
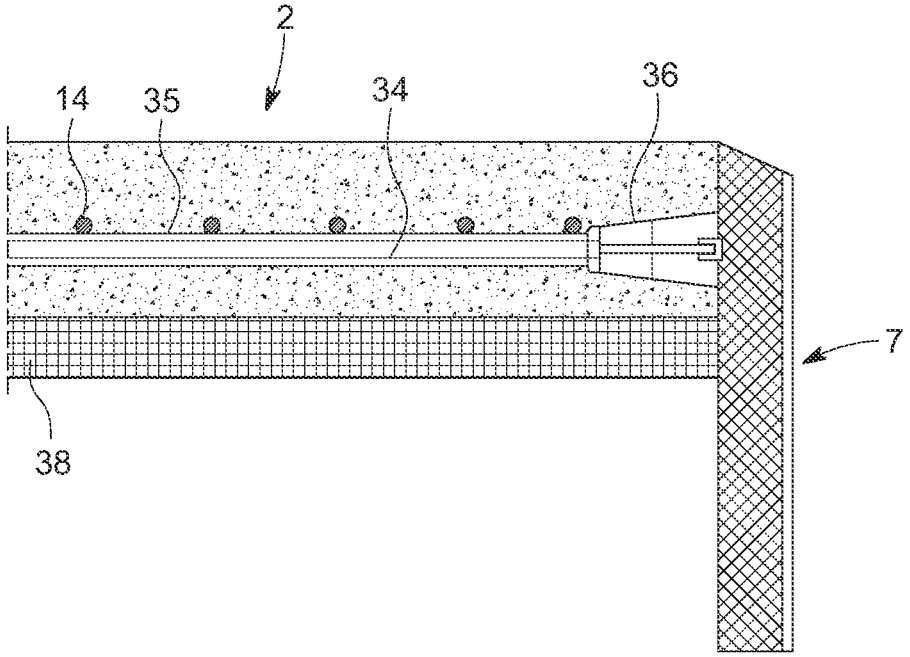
FIG. 12 illustrates a section elevation view of a slab end and the strand detail.
Figure 13:
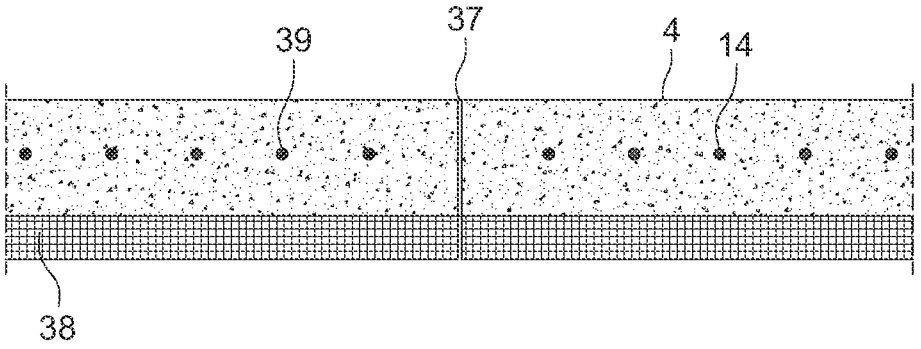
FIG. 13 illustrates a section side elevation view of a typical internal joint between slabs in a system.
Figure 14:
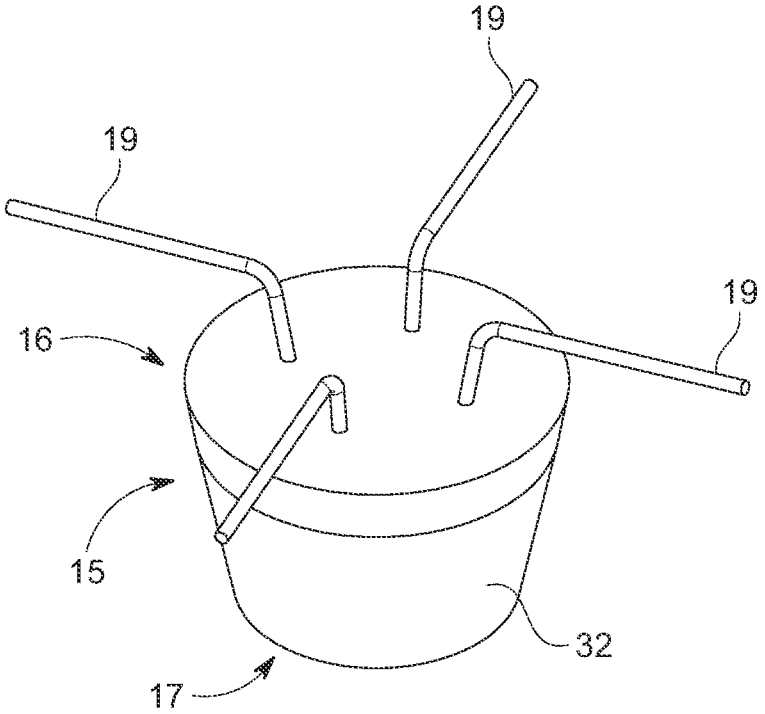
FIG. 14 illustrates a perspective detail view of a plinth as viewed from above.
Figure 15:
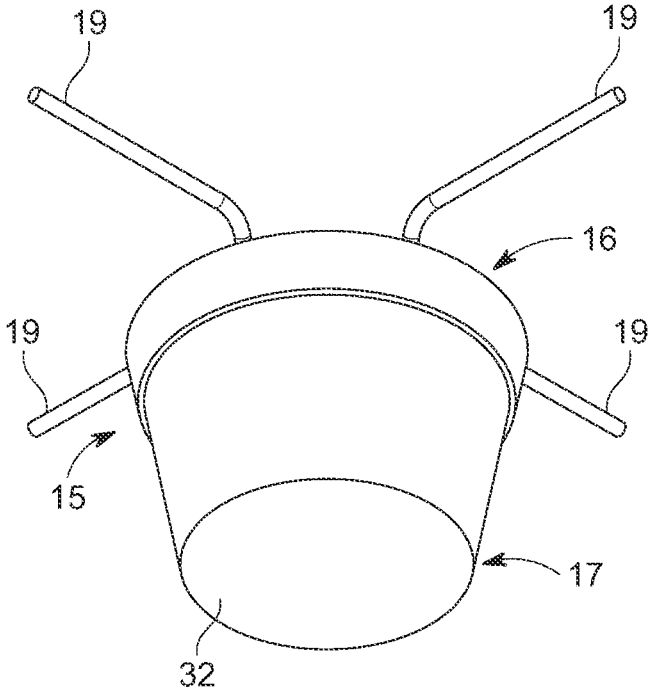
FIG. 15 illustrates a perspective detail view of a plinth as viewed from below.
Figure 16:
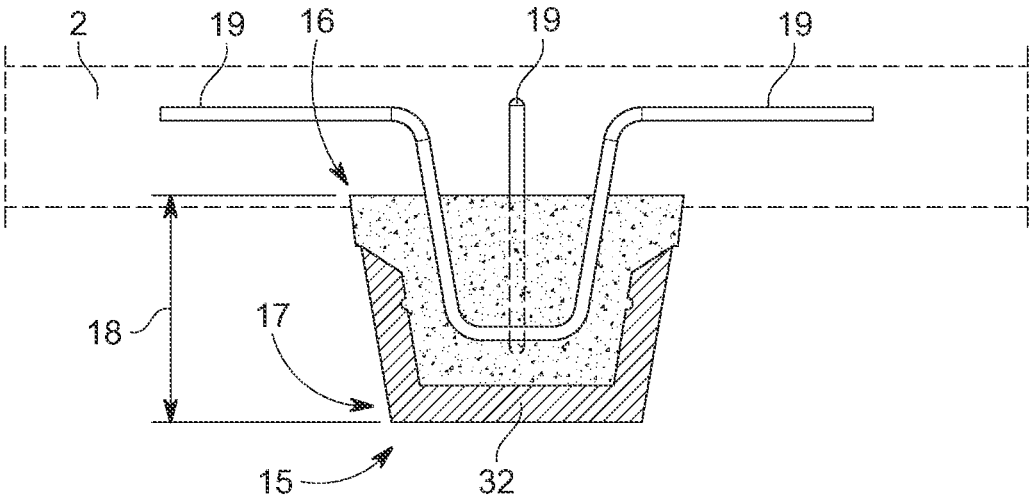
FIG. 16 illustrates a section elevation detail view of a plinth.
Figure 17:
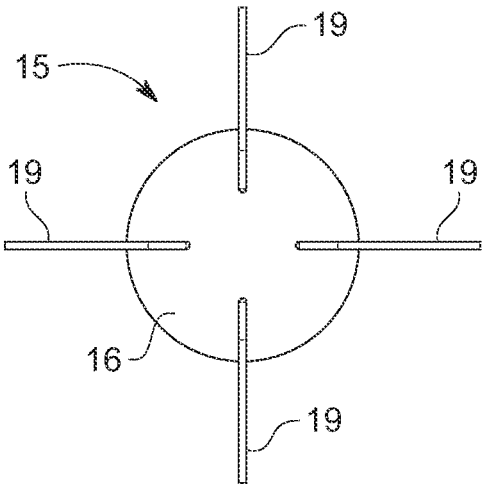
FIG. 17 illustrates a plan view of a plinth.
Figure 18:
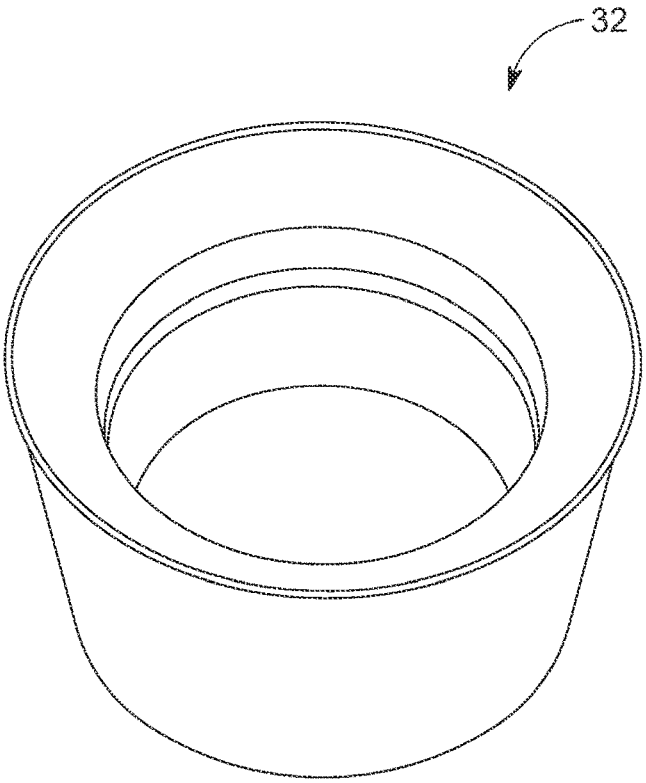
FIG. 18 illustrates a perspective view of a plinth insulating barrier as viewed from above.
Figure 19:
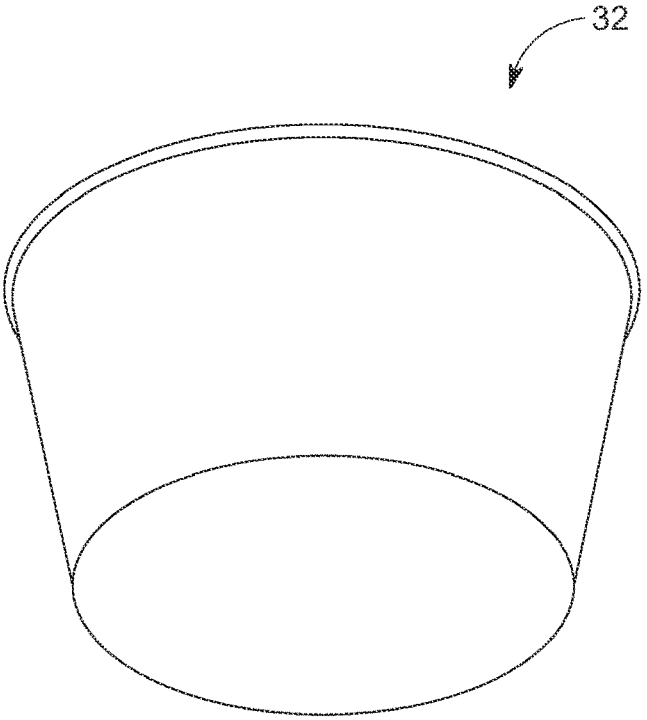
FIG. 19 illustrates a perspective view of a plinth insulating barrier as viewed from below.

As noted above, a modular pre-cast slab, pile and slab system are described along with specific applications and methods of manufacture. The slab or slab system may be pre-insulated and pre-finished before being assembled on site. The slab system may be advantageous to use as a replacement for traditional in-situ poured building foundations. The slab system may also have uses in other fields such as for floors, roads, bridges, pavements/side walks and other civil and structural applications.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

The term 'slab' or grammatical variations thereof refers to a generally planar form structure with a length and width forming the planar form and relatively smaller depth dimension forming the slab side(s). A slab may typically be bound by three or more sides although the slab may also be circular. The slab depth may be uniform or variable in part or in full across the slab area. Typically one side or face of the slab, usually being the upwards face on which a super structure is placed, may be highly uniform in planar form while the opposing side or face may be at least somewhat non-uniform. The opposing side of a slab may be referred to here in as the 'underside' or 'substrate/ground facing side'.

The term 'slab system' or grammatical variations thereof refers to a combination of slabs placed together to form a wider structure.

The term 'plinth' or grammatical variations thereof refers to a narrowed member extending generally away from the planar surface of a slab. Reference for ease of reading is made to the term 'plinth' however this should not be seen as limiting in shape or form as the nature and function of this plinth member may be achieved using a variety of different geometries.

The term 'pile' or grammatical variations thereof refers to a member that acts to at least partially receive a plinth or part thereof thereon or therein. Reference for ease of reading is made to the term 'pile' however this should not be seen as limiting in shape or form as the nature and function of this member may be achieved using a variety of different geometries or even as an intermediate fitting or member.

The term 'complement and seat' or grammatical variations thereof refers to a male/female or cup and ball style arrangement, at least one plinth being received into at least one pile or a part thereof. A reverse configuration may also be possible being at least one pile being received into at least one plinth or a part thereof. Reference will generally be made below to a plinth being received on or into a pile or part thereof however, this should not be seen as limiting and the plinth and pile details noted may be swapped yet still achieve the same function noted.

In a first aspect, there is provided a modular precast concrete slab with plinths extending from the slab that are configured to complement and seat into recesses within at least one pile on which the slab is placed.

In a second aspect, there is provided a modular precast concrete slab with plinths extending from the slab, the plinths having recesses, the recesses being configured to complement and receive piles or parts thereof onto which the slab is placed.

The slab as noted above may further comprise an insulating layer located between each plinth and pile, the insulating layer configured to provide a thermal break between the pile and plinth.

In a third aspect there is provided a pile comprising an elongated shape and configured to at one end be recessed at least partly into the ground and at the opposing end, comprising a recess, the recess size and shape corresponding to a plinth shape, the plinth extending from a pre-cast concrete slab and the pile, acting to locate and retain the pre-cast slab and plinth thereon in place relative to the pile.

In a fourth aspect there is provided a pile comprising an elongated shape and configured at one end to fit at least partly into the ground and at the opposing end, comprising a shape that is configured to be received into a recess in a plinth, the recess size and shape corresponding to a pile end shape, the plinth extending from a pre-cast concrete slab and the plinth, acting to locate and retain the pre-cast slab and plinth thereon in place relative to the pile.

In a fifth aspect, there is provided a modular precast concrete slab system comprising a plurality of precast concrete slabs and piles, the slabs having plinths extending from the slab, the slab plinths configured to be located within a recess on at least one pile or part thereof and the slabs being linked together to form the slab system.

In a sixth aspect, there is provided a modular precast concrete slab system comprising a plurality of precast concrete slabs and piles, the slabs having plinths extending from the slab, the slab plinths configured to with a recess that is configured to receive on at least one pile or part thereof, and the slabs being linked together to form the slab system.

In a seventh aspect, there is provided a building foundation manufactured from the slab system substantially as described above.

In a eighth aspect, there is provided a floor manufactured from the slab system substantially as described above.

In a ninth aspect, there is provided a road or section of road manufactured from the slab system substantially as described above.

In a tenth aspect, there is provided a bridge or section of bridge manufactured from the slab system substantially as described above.

In an eleventh aspect, there is provided a pavement/side walk/pathway manufactured from the slab system substantially as described above.

In a twelfth aspect, there is provided an earth retaining structure manufactured from the slab system substantially as described above.

Slab Insulation

The slab as described above may be pre-insulated. The slab may have insulating material applied to the slab before the slab is delivered to a final site position. Insulation material (termed 'insulation' hereafter) may be applied to the underside of the slab, the underside being the slab face that lies toward a substrate such as ground or earth on which the slab is mounted over.

The insulation may in one embodiment be a foam insulation applied to the slab underside. The foam may be sprayed onto the slab underside.

Alternatively, the insulation may be a board style of insulation and a board or multiple boards may be adhered or fastened to the slab underside.

In a further alternative, the insulation may be at least partly or even completely cast into the slab.

The insulation used may be selected from materials such as expanded polystyrene (EPS), extruded polystyrene foam (XPS), polyurethane (PUR), polyisocyanurate (PIR), and combinations thereof. As should be appreciated, other materials with similar insulating properties or thermal coefficients may also be used.

The amount of pre-insulation that the slab may be supplied with may be dependent on predetermined design factors. For example, the building designer may require an insulation level commensurate with the climate in which the slab is installed. One measure may be the so-called R value of insulation. In the inventor's experience, the degree of pre-insulation possible using the above described slab may range from an R value of 0.25 to 10. For example, the R value may be approximately 0.25, or 0.5, or 0.75, or 1.0, or 1.5, or 2.0, or 2.5, or 3.0, or 3.5, or 4.0, or 4.5, or 5.0 or 5.5, or 6.0, or 6.5, or 7.0, or 7.5, or 8.0, or 8.5, or 9.0, or 9.5, or 10.0.

The exact level of insulation may be dependent, for example, on the insulation type used and the thickness of insulation used.

In one example, a 50 mm thick PUR foam layer may be sprayed to the underside of a concrete slab and may provide an R value of approximately 2.7 to the slab. This insulation material may also have the advantage of being a known and proven product with a 50+ year durability. The insulation, optionally together with ground separation, may also provide a moisture barrier. For example, the slab may meet New Zealand Building Code E2 insulation standard.

Slab Concrete

In one example, the concrete used in the slab may be a 20-60 MPa mix (or 30-50 or approximately 40 MPa mix). The slab concrete may have a depth of approximately 50-300 mm.

In one embodiment the concrete slab depth may be approximately 130-140 mm thick for a two story domestic house on New Zealand technical category 1 (TC1) land.

Slab Flex

The inventor's have found that the slab described may be more resilient than art foundations particularly as regards flexing or elastic deformation capability. In one embodiment the slab may, for a given length of slab, be designed to be able to flex to a greater degree than traditional unstressed slab systems before cracking/plastic deformation occurs. The exact extent of flex may be variable depending on slab designs and the extent of pre-stressing completed but is understood to flex at least 100, or 150, or 200, or 250, or 300, or 350, or 400, or 450, or 500% more than a traditional unstressed slab prior to cracking (plastic deformation) occurring. By way of example, a traditional slab may allow for up to 20 mm flex over a 5 m slab length prior to cracking or plastic deformation. By contrast, the slab described herein may allow for up to 100, or 150, or 200, or 250, or 300, or 350, or 400, or 450, or 500 mm flex over a 10 metre slab length.

Slab Reinforcing

The slab may have reinforcing elements therein. Typical embodiments may use steel reinforcing rod and/or wire strand as the reinforcing elements. Where steel reinforcing rods are used, the rods may be placed so as to form a lattice structure and this lattice structure may be cast into the slab concrete. Wire strands may comprise 7 wires per strand. The wire strands may have a high yield strength of at least 1000, or 1100, or 1200, or 1300, or 1400, or 1500, or 1600, or 1700, or 1800 MPa. In one embodiment, the wire strands in a slab may be orientated in a first direction at regular spacings, the first direction being either generally parallel to the slab longitudinal length or generally orthogonal to the slab longitudinal length.

Typically, the reinforcing elements may be placed and concrete poured over however, concrete could be poured and reinforcing elements then placed into the uncured concrete. In one example, the reinforcing elements may vary from 4 to 20 mm in diameter and placed within the slab at 25 to 500 mm spacings or centres (crs).

Plinth Location

Reference is made hereafter for ease of clarity to multiple plinths (hence plural usage). A single plinth may be used and hence reference to multiple plinths should not be seen as limiting.

Plinths may be located on the underside of the slab.

Plinth and Pile Interaction

The plinths may be received into openings on piles which receive and support the slab when installed. The pile openings may take a variety of shapes or configurations, one example being a circular recess in the pile head and another being a U-shape cross-section opening in a pile head. The term 'opening' as used in the context of the piles generally refers herein to an area of a pile ending that receives part of a plinth therein. A further characteristic of the pile opening is that the opening at least to some extent bounds the extent of movement of the plinth and slab thereon relative to the pile. More detail on piles and plinth form are described below. Note that, as described above, a reverse configuration is also possible using similar elements reversed e.g. a recess or opening in a plinth end that a pile or part thereof is configured to be received in. Reference below is to a plinth being inserted into a pile recess however this should not be seen as limiting.

Plinth Manufacture

Plinths may be cast-in to the slab. Alternatively, plinths may be made separately to the slab and coupled to the slab after pouring and setting. It is anticipated that for ease of manufacture, casting-in may be useful as a manufacturing method since a mould or boxing may be prepared which incorporates both slab and plinth shaping. This may be particularly the case when the slab is produced in a controlled tailor made factory environment.

Plinths may be made from predominantly or completely concrete. Other suitably similar materials with structural properties akin to concrete could be used to form part or all of a plinth e.g. hydroxyl-terminated polyether compounds (HTPE), steel, composite materials.

Plinth Geometry

Given the above described constraint of a plinth needing to be received into a pile opening, the plinth may have a form or geometry which extends at least partly from the slab surface and which may be received into a pile opening.

As may be appreciated, a wide variety of plinth shapes may fit within the above design constraint. In one embodiment for example, plinths may have a cylindrical or conical shape with a circular or semi-circular cross-section and may extend in an elongated manner orthogonally away from the slab underside. Alternatively, plinths may take other shapes such as triangular, square, oblong, hemispherical, ovoid, and so on and have correspondingly varied cross-sections that also at least in part extend orthogonally away from the slab underside.

Plinths may taper at least to some extent from a thicker or wider base linked to the slab through to a narrowed plinth end that is received by the pile opening.

The degree to which plinths extend from the slab may be varied to suit the design and structural requirements. For example, the plinth length (being the distance a plinth extends from a slab) may be a dimension relative to the slab concrete thickness. For example, a plinth length may be the same length or 100% of the slab depths. For example, if the slab concrete depth is 140 mm, the plinth length may also be 140 mm (100%). A plinth length may vary from 10, or 20, or 30, or 40, or 50, or 60, or 70, or 80, or 90, or 100, or 110, or 120, or 130, or 140, or 150, or 160, or 170, or 180, or 190, or 200% of the slab depth. Plinths may be more than 200% of the slab thickness too.

A slab as noted above may have multiple plinths with all plinths of a roughly similar length and form. Alternatively, slabs may be produced having multiple plinths, some or all of the plinths having a varied length and/or form.

Plinth and Reinforcing

Reinforcing members may be placed through a plinth. The reinforcing members may be structural reinforcing steel. The reinforcing members may extend into both a plinth and a region of slab about a plinth.

Thermal Break

The interface between a plinth and a pile may be thermally broken to prevent or at least limit heat transfer between a pile and plinth. An intention of a thermal break may be to produce a thermally broken slab.

A thermal break may be achieved by use of an insulating barrier between abutting parts of a plinth and pile. The term 'insulating' as used herein refers primarily to insulating by preventing or slowing the rate of heat conduction although, the insulating barrier may also influence heat transfer by convection or radiation as well. The thermal conductivity of the insulating barrier and/or materials used to form the insulating barrier may be less than at least: 0.5, 0.4, or 0.3, or 0.2, or 0.1, or 0.05, or 0.01, or 0.005, or 0.001 W/m·K.

In one embodiment the insulating barrier may be achieved through use of an insulating material such as polymer plastic or rubber (synthetic or natural) material (or both) separating parts of the design having higher heat transfer properties. One example may be to separate concrete material used to form a slab or plinth from concrete used to form a pile concrete having a thermal conductivity of approximately 0.8 W/m·K.

In one embodiment, an insulating material may cup or attach to the plinth end or plinth exterior or at least the elongated end of a plinth shape and the same insulating material may then abut the pile about at least part of the opening area. Alternatively, the insulating material may line the pile opening and the plinth end abuts this lining layer in the pile opening.

The insulating material thickness may also be varied to alter the insulating properties. For example, if polymer plastic or rubber (synthetic or natural) material (or both) are used as the insulating material in a cupping shape on the plinth exterior, the insulating material width may be at least 10, or 15, or 20, or 25, or 30, or 35, or 40, or 45, or 50 mm thick. The insulating material in this example may extend around the plinth sides as well as on a face abutting a pile opening.

Pre-Stressing

The concrete panel used to form the slab may be pre-stressed. In one embodiment, the concrete panel may be pre-stressed in one direction only. The slabs may be pre-stressed off site. Pre-stressing may occur in the long direction (i.e. dimension of greater length) and multiple slabs post-tensioned in the opposing direction to pre-stressing on site after multiple slabs have been laid in parallel. Pre-stressing gives the slab strength for transport and in the final position as the slab spans between and over supports.

Pre-stressing may be completed during slab manufacture by laying out and tensioning the wire strands and then pouring concrete over the tensioned reinforcing elements and finally, releasing the tension on the reinforcing elements. Tension may involve pre-stressing the wire strands to 88 kN for a 12.7 mm strand. It should be appreciated that the degree of tension applied may be varied as may the wire strand diameter. Using the alternate embodiment described above, the reinforcing elements may be tensioned and positioned within wet concrete already poured and the tension removed post curing of the concrete. Pre-stressing using wire strands may address both hogging and positive moments.

Integrated Conduits and Piping Systems

The slab may have integrated conduits and piping systems. Cast-in drainage and services as needed per design and at least partly insulated. Integration may be achieved by placing the conduits and piping at least partly into a slab mould and pouring concrete over the conduits and piping that then are held in place once the concrete cures. Insulation may be applied to the conduits or piping before concrete pouring or, for parts outside the concrete slab, post pouring. For example, PUR foam may be applied to part or all of a conduit or piping penetrating the underside of the slab.

Pre-Finishing

The slab surface may be pre-finished during slab manufacture e.g. by grinding, pattern formation, polishing, aesthetic layering or embedding of artistic features and/or sealed or coloured. Pre-finishing may be completed off-site or at installation on-site.

In-Slab Heating

In slab heating may be a further option possible via the described slab and slab system. For example, heating conduits may be cast into the slab during slab manufacture and then the various conduits from multiple slabs connected together on site to a manifold.

Pile Geometry

The pile may have an elongated rod form with opposing ends and a shaft intermediate the ends.

Piles may take a variety of cross-section forms. In one embodiment for example, a pile may have a cylindrical or conical shape with a circular or semi-circular cross-section. Alternatively, piles may take other cross-sectional shapes such as triangular, square, oblong and so on. Piles may be generally straight in length from end to end. Tapering shapes and alternate forms may also be used.

A pile or multiple piles used in slab manufacture may be aligned about a vertical plane so that elongated axis of the pile extends orthogonally from the slab planar face.

One end of a pile may extend towards the slab or plinth on a slab whilst the opposing pile end may extend towards or into a substrate.

The top or slab end of a pile may incorporate the opening described above in which a plinth may be received.

As noted above, a pile may itself extend into a substrate, referred to hereafter as 'ground'. Note that reference to 'ground' should not be seen as limiting since the substrate could be various soils, rock or rocks, a concrete platform, a wooden platform or other substrates on which the slab is to be placed. Where the pile extends into the ground, this may akin to a traditional pile and the pile may extend at least 200, or 300, or 400, or 500, or 600, or 700, or 800, or 900, or 1000 mm into the ground, this measurement being from the pile end extending into the ground to the ground surface. In some applications, the pile may extend up to 20 metres into the ground where deep penetration is required to reach a stable substrate. The pile may also extend above the ground surface to the slab end of the pile by at least 100, or 200, or 300, or 400, or 500, or 600, or 700, or 800, or 900, or 1000 mm above the ground level. This degree of extension above ground level may provide an air gap between the ground level and slab underside. The air gap height may be varied as noted above to suit design requirements and crawl space desired under the slab. In some embodiments, this air gap or distance above ground level may be as much as 10 metres, for example to cater for a sloping site.

Note that, in an alternative embodiment, the pile as noted above may have an end that extends towards a substrate/ground. In this embodiment, the pile end may not actually penetrate the ground and instead mount to a further member above or below ground level, the further member being linked to the substrate in some manner such as being a separate elongated member driven or screwed into the ground or being a cast-in member into a concrete platform. In this embodiment, the pile length may vary in length from at least 100, or 200, or 300, or 400, or 500 mm, this distance being from the pile slab facing end to the opposing substrate directed pile end.

Pile Materials and Strength

The pile or piles described may be made from structural materials and material mixtures. In one embodiment the pile or piles may be manufactured from concrete. The concrete used to form piles may also comprising reinforcing members such as structural reinforcing steel.

In one embodiment, the concrete used in the pile may have an ultimate strength of 20, 21, or 22, or 23, or 24, or 25, or 26, or 27, or 28, or 29, or 30 Mpa. Each pile may also be characterised by having a shear strength of at least 30, or 35, or 40, or 45 kN. This shear strength may be important so as to ensure the piles can withstand the structural loadings imposed on the piles by the slab.

Where generally circular cross-section piles are used, the pile diameter may be designed to ensure bearing demand of the ground as being less than 500, or 450, or 400, or 350, or 300, or 250, or 200, or 150, or 100 kPa ultimate. In one embodiment for example, a pile may have a 600 mm diameter to achieve the bearing demand noted, the piles being sunk approximately 600 mm into the ground in this embodiment.

Pile Opening End

Piles may be characterised as noted above by having an opening that receives a plinth (or vice versa as previously noted).

The opening may be formed directly into a pile end. For example the opening may be cast in to the pile end assuming the pile is manufactured from a structural hardening fluid like concrete.

The opening may be formed instead as a separate member such as a cap that fits on a pile end. The separate member may then have the desired opening shape that receives the plinth.

Pile Opening Shape

The pile opening shape may comprise a recess that at least partly receives a plinth end. The recess may be sized with sufficient tolerance to allow a plinth end to slide, at least to some extent within the recess before reaching a boundary to the recess area.

In one embodiment, the pile may comprise an opening on the pile end, the opening having a recessed internal portion into which the plinth or a part thereof is received, and a wall or walls extending from about the opening recessed internal portion. The wall or walls may at least in part bound the recessed internal portion of the opening.

Wall Embodiments

In one embodiment, the wall or walls of the opening may be continuous so as to fully bound the recessed internal portion. For example, the internal recessed portion may be circular or semi-circular in shape and a continuous wall may extend about the circumference of the opening. In this embodiment, the wall may be described as having an external protruding portion surrounding the internal recessed portion. Note that the internal recessed portion (and continuous wall) may be shaped in a non-circular manner e.g. square or other polygonal shapes or tortuous paths and a continuous wall may still, with this varied shape, extend about the circumference of the opening.

In an alternative embodiment, the wall or walls may be discontinuous and may not fully bound the recessed internal portion. For example, the internal recessed portion may be generally oblong in shape and be partly bound on two or three oblong sides. This embodiment may be used to restrict relative movement between a plinth and pile about a particular plane. That said, the spacing between opposing walls may be designed to be sufficient to allow at least some relative movement.

The wall or walls described in the above embodiments may at least partly overlap the plinth end and, when a plinth is received into an opening, movement of the plinth relative to the pile about a pile end plane (typically a horizontal plane) may be constrained by the wall or walls of the opening.

To illustrate the above embodiments further, the recess may for example be cast in to the pile end, the pile end comprising a recessed internal portion having a circular diameter with a fully surrounding wall about the recessed internal portion, the wall extending out from the internal portion ending to the pile end edge. When viewed end on, the pile end in this configuration may appear as two concentric or at partially offset circles, one being the outer pile diameter and the other being the boundary of the recess. Non-concentric alignment may occur when a pile is not perfectly positioned. A slight offset in concentricity allows for some tolerance yet does not alter the structural capabilities. In this embodiment, the ratio of recess diameter to overall pile diameter may be approximately 0.5 to 1.5:2 i.e. if the overall pile diameter is 600 mm, then the recess diameter may be approximately 150 to 450 mm.

Relative Movement

As may be appreciated from the above, the plinth and pile may not be purely aligned about a common longitudinal axis and may instead but somewhat offset, termed hereafter as a relative movement. The degree of relative movement envisaged by the inventors between a plinth and pile based on current designs may be approximately 5, or 10, or 15, or 20% of the pile diameter For example, if the pile diameter is 600-1000 mm, the plinth and pile may undergo relative movement about a horizontal plane of at least approximately +/−0 mm to 90 mm or 10-80 mm, or 20-70 mm, or 20-50 mm. In practice, this usually is represented by the plinth sliding within the internal pile recess during installation, the extent of sliding movement being bound by the pile wall or walls surrounding the recess and the extent in part being a factor of the plinth end size relative to the pile recess size and wall width. Reference is made herein to the relative movement being in a horizontal plane however the slab, plinths and/or pile interface need not be wholly in a horizontal plane and reference to a horizontal plane should not be seen as limiting.

Levelling and Tolerances

In some embodiments, it may be desirable to have a very accurate horizontal plane within the pile end recess face. In the inventor's experience, piles can be manufactured and positioned to a reasonable degree of accuracy (+/−1-5 mm). It may be desirable to reduce this variation still further. For example, if the plinth too has a flat end face that abuts the recess face, it may be desirable to engineer the abutting faces to have as little gap or height variation as possible therefore minimising any tolerances.

Slight manufacturing variations in recess level may be addressed via the use of a levelling compound. Levelling compound may be applied to the recess surface for example to correct pile level variation. If applied, the levelling compound may be 1, or 2, or 3, or 4, or 5 mm thick.

Height variations in pile/recess height may at least in part be taken up by shims or spacers inserted into the recess between the plinth end and recess base.

The adjustments possible as noted above may reduce the final height variation/tolerance to less than +/−0.5 mm.

Grout Use

If desired, any open regions between the plinth walls and recess wall or walls may have grout added. This may be done to partly or fully fill any cavity area within the recess not taken up by the plinth. The grout may also be used to fix the relative position between the plinth or recess. The grout may itself provide some strength and may for example be a grout of approximately 10, or 15, or 20, or 25, or 30, or 35, or 40, or 45, or 50, or 55 or 60 MPa.

System

A slab system may comprise multiple slabs joined together and fitted to piles.

Piles may be manufactured off site and then pre-installed on site prior to slab delivery. The piles may be driven into the ground on site or placed into pre-dug holes. As noted above, the piles may alternatively be wholly above ground and fixed to a substrate such as a concrete platform or wooden piles.

Typically, and as noted above, the piles may provide a height that confers an air gap between the ground and slab underside.

Preformed modular slabs may be delivered to site and fitted onto the piles together to form the slab system.

Adjoining slabs may be abutted and joined together. Joining may be a process of compressing adjoining slabs together about a joint. The inventors have found that a simple butt joint may be sufficient between slabs and there may be no need for special joints and unusual geometry between the slab sides hence reducing manufacturing complexity and cost.

Adhesive and/or filler may be positioned between part or all of the abutting regions between slabs. This may be useful to urge more complete joining and to fill or smooth any gaps or surface imperfections particularly on the final upwards floor facing side of the slabs or slab system. Where adhesive and/or filler is used, the adhesive or filler may be applied prior to post-tensioning. The filler may be grout or a similar material. Adhesives that could be used may include gorilla glue/polyurethane (PU) and/or epoxy adhesive.

After adjoining slabs are placed on the piles, a slab or multiple slabs may under go post-tensioning. Post-tensioning may be completed on site. Post-tensioning may be completed by tensioning the slab or slabs in a direction orthogonal or within +/−10 degrees to an orthogonal direction relative to the direction of panel pre-stressing via further wire strands threaded through and fixed to one or more of the slabs. The wire strands used for post tensioning may be threaded through openings in the slab. The openings may be lined or formed by conduit set into the slab concrete.

In the slab system described, slab plinths and piles may not be fixed to each other. It is envisaged that the plinths and piles may abut each other and the plinths may simply rest on the piles through gravity. As may be appreciated, this relationship between plinth and pile may result in a sliding arrangement between the slab plinths and piles i.e. the plinths and piles may slide relative to one another, at least to some extent, typically about a horizontal plane or which ever plane the plinth and piles traverse or align.

Slab and Slab System Edges

Each slab in a slab system or external slab edges in a slab system comprising multiple slabs may be pre-finished. Each slab in a slab system or, external slab edges in a slab system comprising multiple slabs, may be thermally isolated. Pre-finishing and/or thermal isolation manufacturing and materials may be applied off-site prior to assembly on site.

One example of pre-finishing may be to polish and grind an external edge of a slab or slabs and/or to apply sealant or colouring to the edge(s).

One example of thermal isolation may be to apply insulation material to the edge(s). The insulation material may be the same as those described above for under the slab e.g. insulating foams affixed to the edge(s). Such insulation may be applied to the slab system once multiple slabs are placed together on-site.

Aside from the above, other external structures and materials may also be applied such as a veneer, cover or exterior cladding generally if desired.

Addressing Seismic Movement

One characteristic of the above described slab system is that it may be easily adjusted post any movement that occurs due to seismic or other relative movement between the slab system, piles and substrate. For example, if a pile or piles on which the slab system is placed were to drop in height, the plinth may be lifted relative to the pile head by elevating the plinth using a spacer or spacers to take up graduations in height difference and thus re-levelling the slab system surface.

Advantages

As may be appreciated from the above description the slab, slab systems and piles described may provide a variety of benefits relative to art foundations or other structural platforms. In more detail, advantages known or envisaged by the inventors of the described slab, slab system and piles may be one or more of the following:

- The slab and slab system described may be totally thermally broken unlike art foundations that often cannot achieve a full thermal break;
- The slab and system described may provide a water barrier between the ground and a structure on the slab or slab system;
- Slab surfaces and/or edges may be treated prior to installation thereby speeding construction on site and enabling more controlled manufacturing conditions. Tolerances may in, in the inventor's experience, be +/−2 mm when produced under such controlled off site conditions;
- The production process of a slab from design to end of slab installation may be completed by one supplier on one site and not reliant on multiple suppliers and contractors as is typically the case in art methods often leading to time delays and more complexity in project management;
- The slab and slab system described virtually eliminates curing shrinkage cracking and imperfections since the pre-casting process is done under repeated and controlled conditions offsite. Art in-situ foundation manufacture is inherently prone to imperfections through varying weather, varying contractors, less control on concrete quality and other variables that cannot be carefully controlled and managed;
- The slab, slab system and piles described may be manufactured to a very high level of precision providing tight construction tolerances compared to in-situ pours where tolerances are inherently variable. Typically in in-situ pours, construction tolerances are +/−10 mm in plane and +/−10 mm in level. The slab described above is envisaged to have tolerances of +/−1, or 2, or 3, or 4, or 5 mm in plan and level this gives the system greater seismic resilience;
- The slab, slab system and piles described may have a consistent and high quality finish compared to in-situ pours where surface variations are common;
- The slab described is likely to be less vulnerable to cracking caused by seismic events since the slabs are pre-stressed and the slabs or slab system as a whole are post-tensioned which collectively improves the flexibility or elastic deformation characteristics of the slab system to an extent greater than traditional slab systems;
- The slab and slab system described herein may minimise or even eliminate water uptake and degradation to any super structure on the slab or slab system;
- The speed of onsite construction time of a slab system may be dramatically reduced since pouring and curing may be completed off site. It is envisaged that the time period from a bare site to a slab system ready for super structure such as framing to be installed may be approximately 1 week for the described slab and slab system. By comparison, an in-situ poured foundation typically requires 3-6 weeks for the same process to occur;
- Due to the high tolerance possible. This method lends itself well to use of pre-fabricated modular factory manufactured super-structures requiring high work tolerances;
- The manufacturing process of slabs may be scaled up to produce multiple slabs in a shorter time period than existing in-situ pour methods thereby enabling the ability to meet the demand for faster and greater volume of build projects;
- Because the slabs are manufactured offsite and typically in a weather proof facility, weather on site plays only a minimal if any role to hindering the process of manufacture. In-situ pour methods can be quite weather dependent with adverse weather having a significant impact on timing and speed of manufacture. In some climates, concrete foundation manufacture simply cannot occur for some months of the year due to inability to properly cure the concrete for example. Off site and controlled manufacture may allow construction to proceed even in these adverse climatic conditions;

Because the slab and slab system are located on piles of a known and pre-determined size and form, the disruption to the substrate/ground on site may be minimised. There may be minimal if any need to disturb the ground outside of the area bound by the overall slab placement area. Minimising ground disruption may also reduce the need for silt and sediment control during construction and hence associated costs from control measures. Minimising ground disruption may further reduce earthwork volumes such as top soil removal from the site and hard fill imports to the site.

Examples are now described to illustrate specific embodiments of the above description.

Example 1

In this example, one embodiment of a slab system, slab and pile is described with reference to FIGS. 1-19.

Broadly, the slab system 1 as illustrated comprises multiple slabs 2 joined together to form a floor or building foundation as illustrated on which a superstructure 3 may be built.

Each slab 2 in the slab system 1 comprises an upper surface 4, an underside 5 and external slab edges 6.

The slab 2 external edges 6 may be pre-finished. For example, the external edges may be polished or ground or a veneer or insulating layer added as illustrated by item 7 in the figures.

The slabs 2 and slab system 1 rest above a substrate e.g. the ground 8 and an air gap 9 may be between the ground 8 and slab 2 or slab system 1 underside 5.

Slabs 2 may be manufactured primarily from concrete having a depth 10, length 11 and width 12, generally in the form of a planar rectangular shape like that shown in the Figures.

A slab 2 as designed herein may have a flex resilience in direction F comparatively higher than art slabs.

Each slab 2 may comprise slab reinforcing elements shown in the figures as reinforcing rods 13, the reinforcing rods 13 form a lattice structure. Slabs 2 also comprise wire strands 14.

Each slab 2 may be pre-stressed during curing. Pre-stressing may be achieved by placing the wire strands 14 in tension prior to the concrete setting and then removing the tension post setting. The wire strands 14 may be tensioned in one direction only, typically about the slab 2 long direction i.e. dimension of greater length 11.

The reinforcing rods 13 and wire strands 14 may have a predetermined diameter and located at specific and regular spacings or centres throughout the slab 2.

Slabs 2 comprise multiple plinths 15. Each plinth 15 has a base 16, end 17, the base 16 and end 17 separated by a column shape extending generally orthogonally away from the slab 2 underside 5 about a plinth 15 longitudinal axis 15*a*. Each plinth 15 has width or diameter/circumference. Plinths 15 have a cylindrical or conical shape with a circular or semi-circular cross-section.

The plinths 15 may, as shown in the Figures, be cast-in or integral to the slab 2.

The plinths 15 may taper from a thicker or wider base 16 at the slab 2 underside 5 through to a narrowed plinth 15 end 17.

Each plinth 15 has a length 18 being the distance a plinth 15 extends from a slab 2.

Plinths 15 may comprise reinforcing steel 19 extend into both a plinth 15 and a region of slab 2 about a plinth 15 base 16.

The slabs 2 and plinths 15 may interface with piles 20.

Piles 20 comprise in the figures shown an elongated shaft 21. The elongated shaft 21 axis 22 extends orthogonally from the slab 2 underside 5 generally coincident with the plinth 15 longitudinal axis 15*a*.

Piles 20 have a pile end 23 that is recessed into the ground or substrate 8 and an opposing pile 20 pile head 24 comprising a recess generally shown by arrow 25.

Each pile 20 recess 25 comprises an opening having a circular shape recessed into a pile 20 head 24. The recess is formed directly into the pile 20 head 24 e.g. cast in to the pile end assuming the pile 20 is manufactured from concrete or a similar structural hardening fluid.

Each pile 20 recess 25 opening is sized generally larger than the plinth 15 end 17 so as to provide a degree of tolerance to receive and nest within a plinth 15 end 17.

Each pile 20 recess 25 has a wall or walls 26 extending from a recess 25 interior or base 27. The wall or walls 26 bound the recess 25 interior 27.

The piles 20 may also comprise reinforcing members 28 such as structural reinforcing steel.

Levelling compound 29 may be applied to the recess 25 interior 27 to alter pile 20 level. Shims or spacers 30 may be inserted into the recess 25 between a plinth 15 end 17 and recess 25 interior 27.

Open regions 31 between the plinth 15 and recess 25 wall or walls 26 may have grout added (not shown).

A thermal break generally indicated by arrow 32 may be located between a plinth 15 and a pile 20. A thermal break 32 may be achieved via use of an insulating material such as polymer plastic or rubber (synthetic or natural) material (or both). In the Figures, a thermal break 32 is achieved using cups that attach to a plinth 15 end 17 and which extend around part of the plinth 15 exterior.

Multiple slabs 2 may be linked or joined together. Linking/joining may be achieved via a process of compressing adjoining slabs 2 together about a joint 33. One means of causing compression between slabs 2 may be to post tension the slabs 2 together using multiple wire strands 34, the wire strands 34 threaded through pre-formed openings 35 in the slabs 2 and the wire strands 34 then tensioned to pull together the slabs 2. The openings 35 may be formed in the slab during curing using conduit. This processing of joining slabs together via wire strands is termed here in as post-tensioning. Openings 35 between the slabs 2 are positioned to coincide and strands 34 thread through multiple slabs 2. Openings 35/strands 34 are located in a direction orthogonal to the direction of pre-stressed reinforcing rod 13 in the slab 2.

Strands 34 may have a keyed ending 36 that locks into the slab 2 providing a fixed point from which the strands 34 may be tensioned and then locked off in a tensioned position.

Adhesive and/or filler generally indicated by arrow 37 may be positioned between part or all of the abutting regions between slabs 2.

An insulating layer 38 may be applied to the slab 2 underside 5. In the Figures, the insulating layer 38 is shown as foam insulation sprayed onto the slab 2 underside 5.

Integrated services connections 39 such as conduit and piping systems e.g. cast-in drainage and services may be included in a slab 2 or slab system 1.

A slab 2 upper surface 4 may be pre-finished e.g. by grinding, pattern formation, polishing, aesthetic layering or embedding of artistic features and/or sealed or coloured.

In-slab heating may be added e.g. heating conduits may be cast into the slab during slab manufacture and then the various conduits from multiple slabs connected together on site to a manifold (not shown).

Example 2

Figure 27:
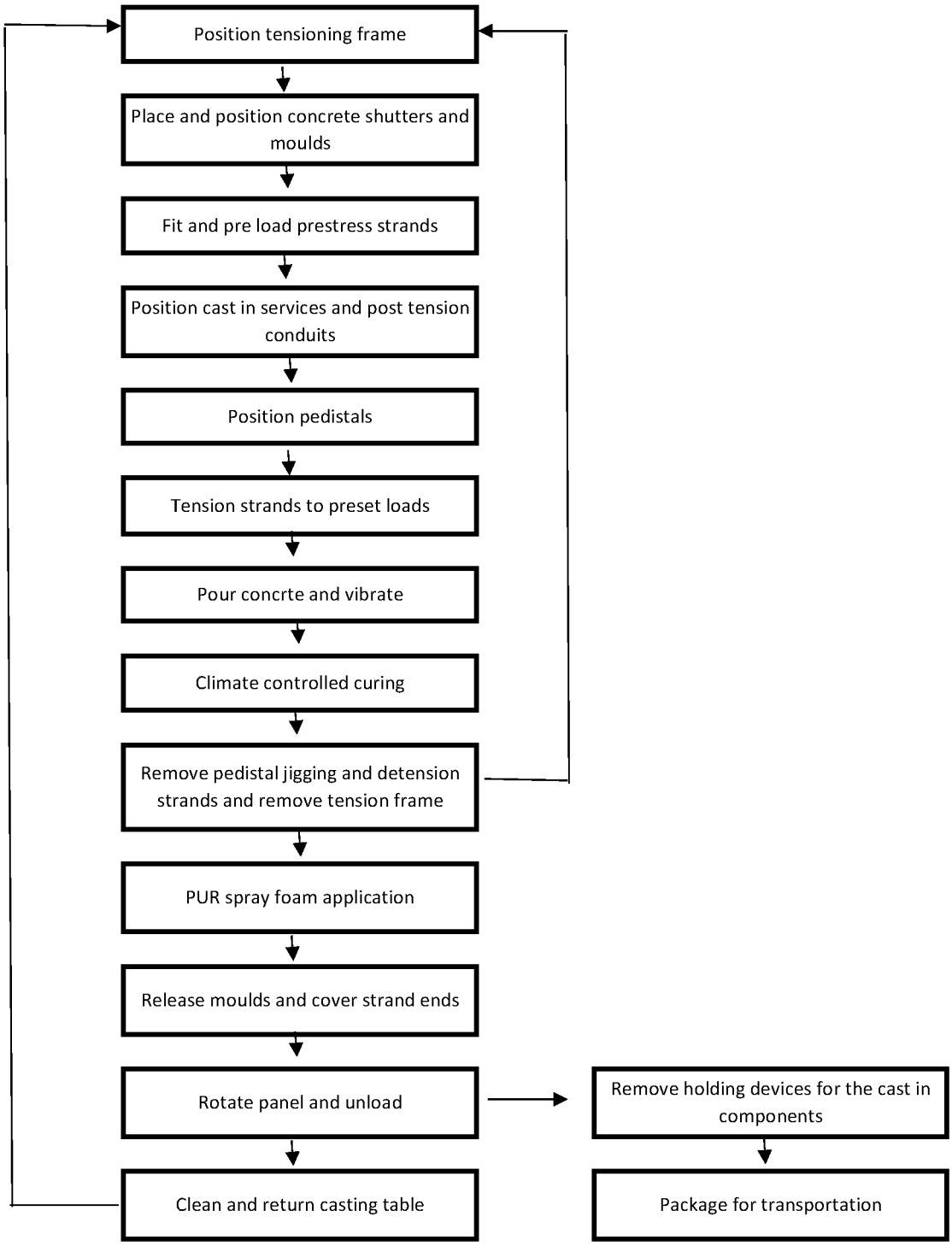
FIG. 27 illustrates an example flow diagram of a process of manufacturing a slab.

In this Example, a method of manufacture of a slab such as that used in the embodiment of Example 1 above is described. Reference is made to the process flow chart shown in FIG. 27 which describes a typical manufacturing process completed offsite in a specifically designed slab manufacturing facility.

Initially a tensioning frame is positioned and shutters and/or moulds located with respect to the frame. Moulds may be positioned with a premeasured spacing rod or laser positioning. Any drop in larger moulds may be placed if required such as those used for shower recesses.

Pre Stress cabling—Insert pre-cut strands through moulds and lock into the tensioning frame. Pre Stress to a set value (this is a low load state that does not create safety issues when working around the strands, but maintains their correct position. Inserts around strand ends to be threaded to strands.

Cast in set outs—A laser system is used for the positioning of plumbing fittings and piping, electrical components, and optionally door recesses. Post tension conduits as required. Steel rods may be fitted inside conduits to ensure there is no bending.

Off line station for specialty components—Fit heating piping if required. Any other specialty items to also be fitted at this point. Pedestals are installed at this point as well.

Strand tension—Individual tensioning of strands. Initial positions are marked. Strands are pulled to set tension.

Pouring and vibrating—Pour concrete. Vibrating as needed.

Curing—Complete controlled climate curing.

Detensioning—Remove pedestal jigs. The strands are released by untightening lock nuts on the tensioning frame. Strands are cut from the tensioning frame. The frame is lifted and relocated. Any additional items to be set in place prior to insulation addition. Fit spray caps over the pedestals.

Insulation spraying—Application of spray PUR to the concrete slab element.

Release moulds—Release the end moulds and cut and cap strands. Extract any metal rods inside conduits (if present).

Unloading—Pallets are flipped into pedestals ready for removal by forklift.

Final preparation for transport—Remove face mounted inserts and holding devices. Verify labelling. Quality assurance check of final face of element.

Example 3

In this Example, a method of site installation of a slab such as that used in the embodiment of Example 1 above is described.

Survey Datum—Set up of a datum for height by the surveyor.

Site clearance—Scrape the ground surface as required in accordance with plans. Some sites will require preliminary excavation.

Pile set out—Survey positions are generated from the Engineering team on a file that is then imported to the survey equipment. Each pile centre position is pegged. Ground topography is checked against file data.

Piling—Auger piles with auto cleaning drill on a digger. Depth in accordance with the design documents.

Hole form work set up for each pile—Select formwork ring in accordance with pile height above the ground. Place the form work in the hole.

Support blocks—Peg 3 support blocks at 120 degrees apart around the mould.

Set to height—Set laser to the pile height from the datum. Use the form work clamping system for securing the laser and lift the form work to the correct position directly above each support block. Nail gun the form work to the support block.

Steel and rebate moulds—Place out the steel reinforcing to each pile position. Verify the steel length is correct for each hole. Place the steel and mould into each hole. 75 mm min and 200 mm max of steel cover from the bottom of the hole is required.

Concrete—Fill pile holes with concrete. Fill from one side and vibrate to ensure no air pockets under the mould. Screed of the top surface. Leave 24+ hrs to cure Note that the steel and rebate mould step and concrete pouring steps may be reversed to the above order i.e. steel could be placed into poured (wet) concrete.

Remove moulds—Remove moulds and clean ready for reuse

Grout levelling—If needed, place a self-levelling grout in the rebate to ensure the hole base is very level. Allow to cure (24+ Hours).

Floor panel installation—Verify slab locations. Set packers to set height with high accuracy level to +/−0.25 mm. Fit grout lines to piles that cannot be accessed from the slab edge. Lift in the first panel. Position with survey equipment or via use of profile lines. Glue butt joint faces. Join panels together by placing the panel into position and feeding the post tension cable through the slab openings. Repeat for all panels continuing to feed post tension cables through all slabs.

Post tension—Connect end wedges to cables. Stress cables. Cut, cap and grout fill the cables.

Pile Grouting—Fill each pile grout through the preinstalled pipes to the piles in the centre of the slab.

Side panel install—The panels are glued with nails used for holding while the glue cures. Detail on the procedure to be completed later once the surface coating is selected.

Example 4

This example describes alternative plinth designs, referring to FIGS. 20-23 which show alternative plinth/pile designs.

Figure 20:
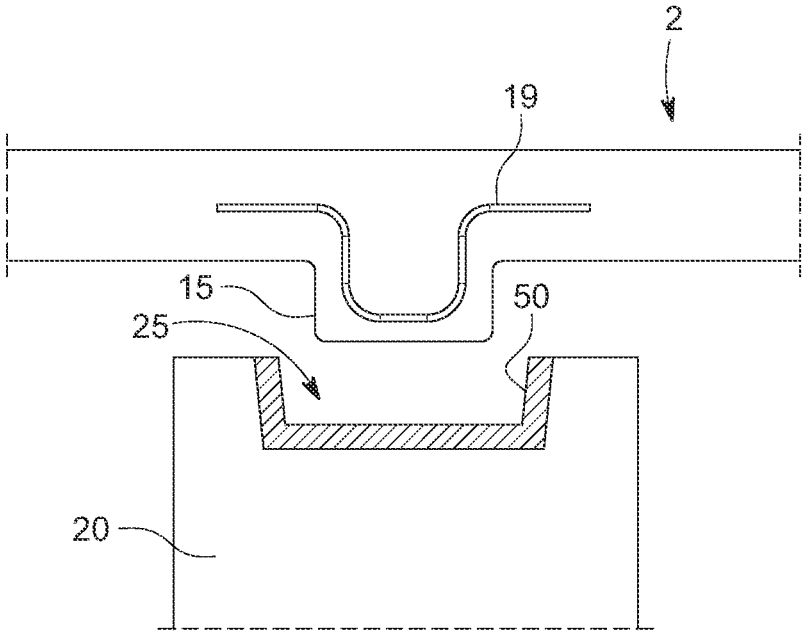
FIG. 20 illustrates a schematic side cross-section view of an alternative plinth and pile embodiment with an insulating layer located on the pile.

FIG. 20 illustrates an embodiment where the insulating layer 50 between the plinth 15 and pile 20 is located in the pile 20 recess 25 as opposed to being a cap or boot on the plinth 15 described in Example 1. In this case, the insulating layer 50 is a cap or lining in the pile 20 recess 25 that covers the recess 25 interior and side walls.

Figure 21:
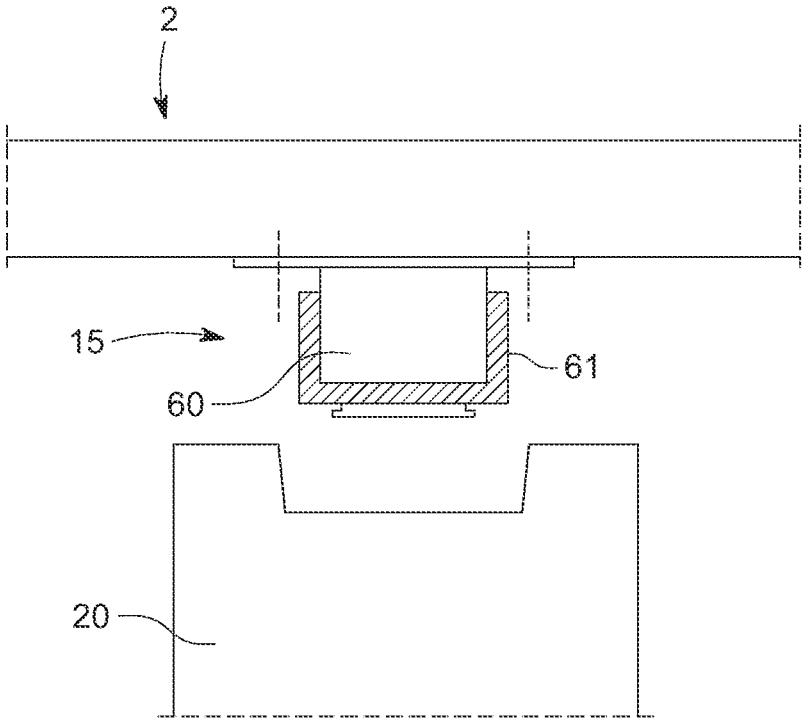
FIG. 21 illustrates a schematic side cross-section view of a further alternative plinth and pile embodiment using a pedestal.

FIG. 21 illustrates an alternative design in this case having the plinth 15 formed by a steel or rubber block 60 mated to the slab 2 and the plinth 15 block 60 mating with a steel or rubber pedestal recess 61 in/on the pile 20. Rubber in this case would be the insulating material. This Example illustrates how the plinth 15 and pile 20 need not be concrete or at least not be concrete about the interface. Also illustrated is how the plinth 15 need not be integral to the slab 2. Further illustrated is the use of a pedestal within the pile 20 recess.

Figure 22:
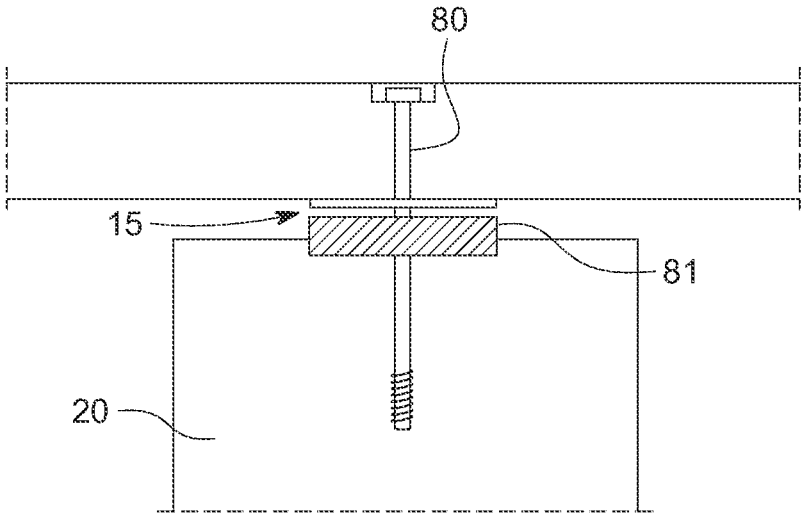
FIG. 22 illustrates a schematic side cross-section view of a further alternative plinth and pile embodiment using a bolt.

FIG. 22 illustrates a further embodiment with the plinth 15 being formed with a bolt 80, the bolt extending about the plinth 15 longitudinal axis and into the pile 20 recess. The bolt 80 may also mate with and pass through a shim or shims 81 in the pile 20 recess.

Figure 23:
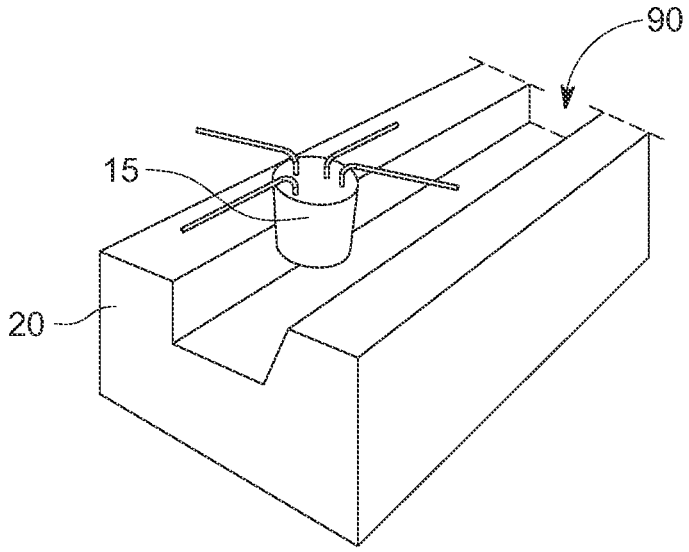
FIG. 23 illustrates a perspective view of an alternative pile design where the pile comprises an elongated channel recess.

FIG. 23 illustrates an alternative pile 20 recess shape. Example 1 illustrated a circular recess. By contrast, FIG. 23 shows how the recess may be formed as an elongated channel 90 that receives at least one plinth 15 end therein. The elongated channel 90 shown in fact receives two plinth 15 ends therein and may be sized accordingly. As may be appreciated, the channel 90 length may in fact by elongated still further than that shown to located multiple plinths 15.

Example 5

As noted in Example 1, the slab system 1 may be useful in building foundations and floors. As may be appreciated, the same design may be used for a variety of other structures such as roading, railways, walkways or platforms. It is envisaged for example that the structure described may be located above a waterway or poor ground and the pile and slab system described used to bridge that waterway or poor ground.

Figure 24A:
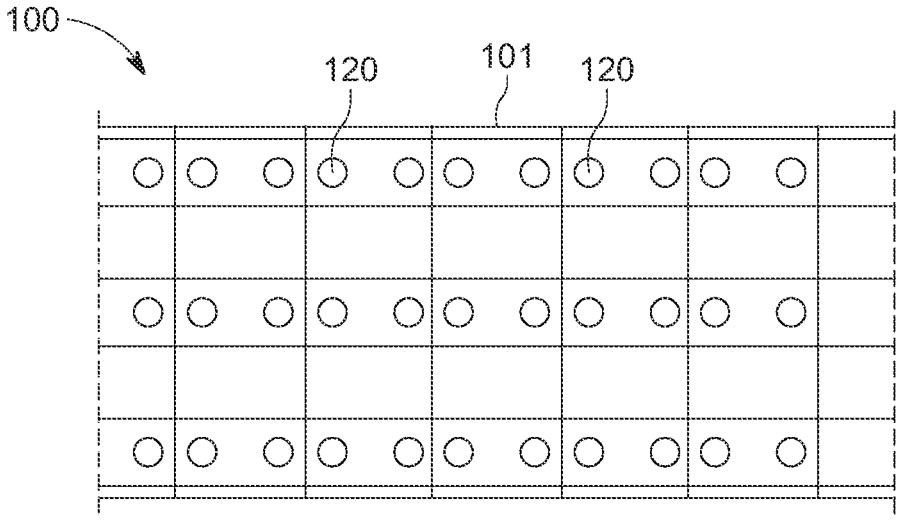
FIGS. 24*a* and 24*b* illustrate road, rail, walkway or platform schematic views of the slab system.
Figure 24B:
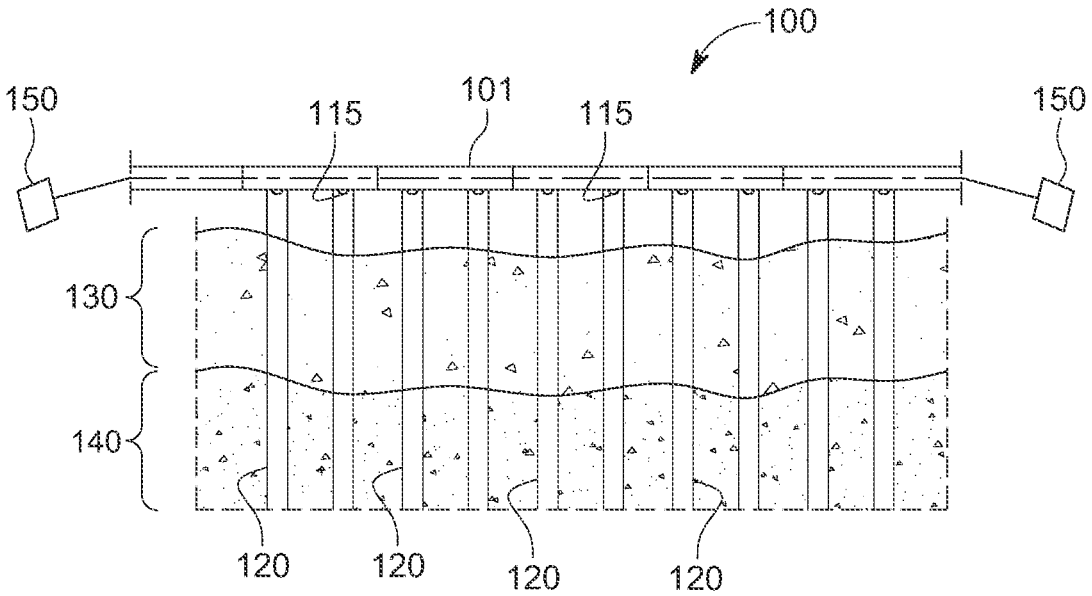

FIG. 24*a* shows an example plan view of a road/rail/walkway or platform embodiment generally indicated by arrow 100 and FIG. 24*b* illustrates a side view of the same embodiment.

The design shown comprises a slab system indicated by arrow 101 comprising plinths 115 mating with piles 120. In this example, the piles 120 extend into a substrate past a poor ground or water section 130 and into a good ground section 140. Some additional retention means may be needed, illustrated in FIG. 24*b* as being anchors 150 on either side of the slab system 101.

Example 6

As noted above, the plinth and pile arrangement functions like a male/female or cup and ball style arrangement. Example 1 and Example 4 describe embodiments where a plinth is received into a pile or a part thereof.

Figure 25:
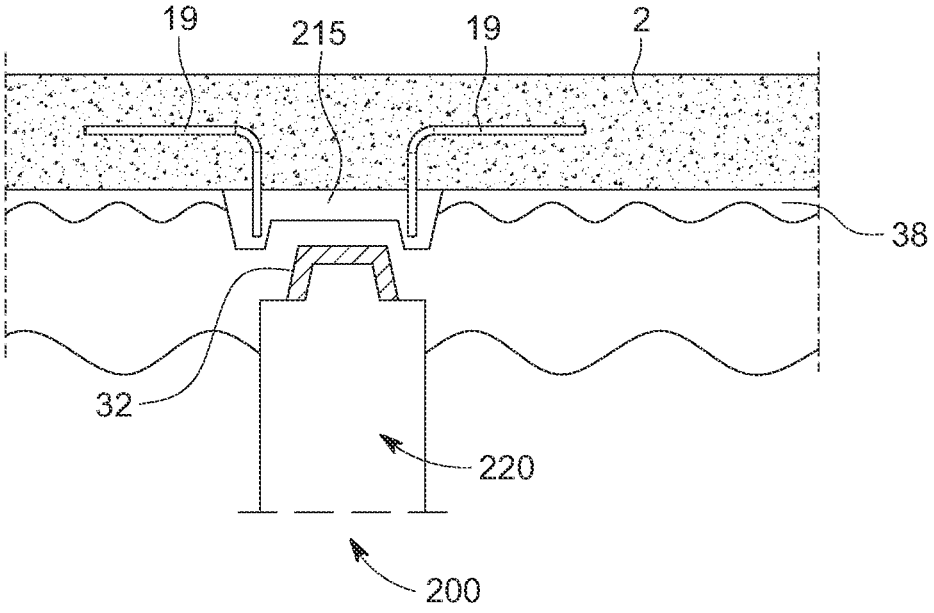
FIG. 25 illustrates a schematic side cross-section view of an alternative reverse configuration embodiment with a pile being received into a plinth recess.

A reverse configuration generally indicated in FIG. 25 by arrow 200 is also possible being a pile 220 received into at least one plinth 215 recess or a part thereof. The pile 220 head comprises the male end feature and the plinth 215 comprises the female recess feature.

Example 7

Figure 26:
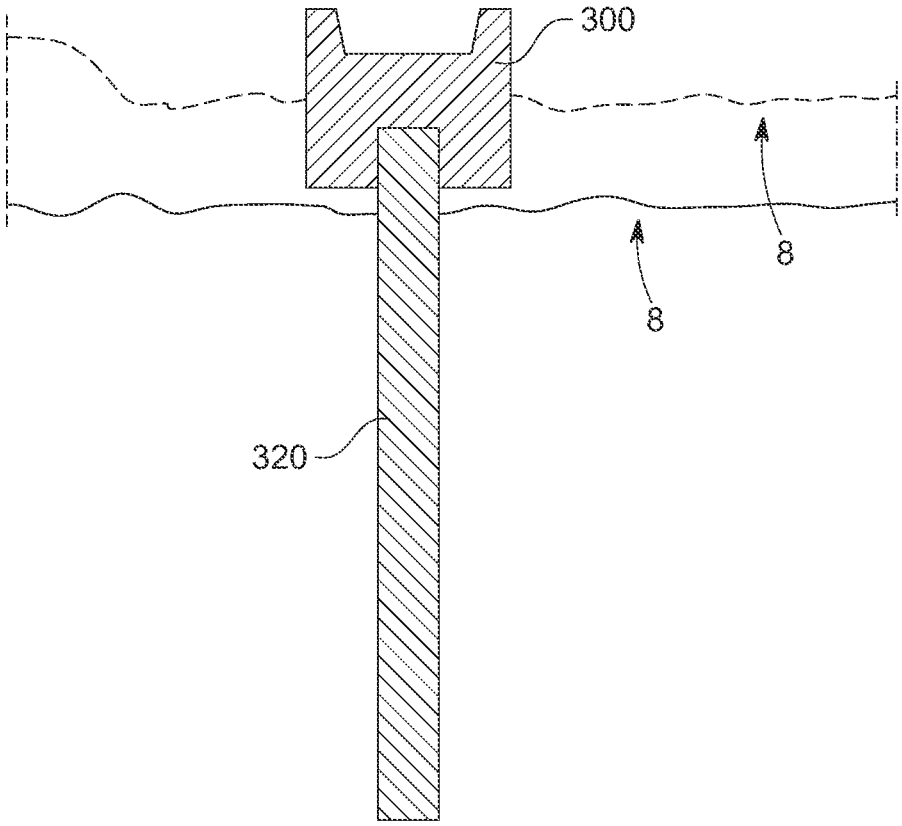
FIG. 26 illustrates an alternative pile design using a cap pile head with a recess mounted on an elongated pile such as a screw pile that extends deep into a substrate.

As noted in the above description, the pile recess end may be formed integral to the generally elongated form of the pile or may be a cap or separate end item to the pile. FIG. 26 illustrates an alternate embodiment of pile 320, in this case comprising a cap 300 linked to the pile 320 top. This cap 300 comprises a similar recess form to the pile 20 described in earlier embodiments and has a similar interaction with a plinth 15. An arrangement of this nature may be useful where deep piles are needed e.g. screw piles, H-section beams, I-beams and so on used for or about poor substrates. In this way a traditional steel screw pile for example could be used and a cap 300 applied thereby avoiding the need for specially designed screw piles or similar piles.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as of individually set forth.

Aspects of the slab, slab system, piles and methods of use thereof have been described by way of example only and it should be appreciated that modifications and additions may be made thereto without departing from the scope of the claims herein.

What is claimed is:

1. A pile comprising an elongated shape and configured to, at one end, be recessed at least partly into ground and, at an opposing end, comprising an opening therein, a size and shape of the opening corresponding to a shape of a plinth received into the opening, and the pile configured to locate and retain the plinth and a pre-cast slab on the plinth in place relative to the opposing end of the pile, and further comprising an insulating layer located between the plinth and the pile, the insulating layer configured to provide a thermal break between the plinth and the pile.

2. The pile as claimed in claim 1, wherein the size of the opening in the opposing end of the pile is greater than an end of the plinth seated in the opening to allow movement of the plinth relative to the pile.

3. The pile of claim 1, wherein the opening on the opposing end of the pile is circular and has a U-shape cross-section extending into the opposing end of the pile.

4. The pile of claim 1, wherein the pile opening bounds the extent of movement of the plinth and slab thereon relative to the pile.

5. The pile of claim 1, wherein the plinth tapers at least to some extent from a thicker or wider base linked to the slab through to a narrowed plinth end that is received by the pile opening.

6. The pile of claim 1, wherein the opening in the opposing end of the pile is sized with sufficient tolerance to allow a plinth end to slide, at least to some extent within the opening before reaching a boundary to the opening area.

7. The pile of claim 1, wherein a wall or walls extend from about the opening that at least in part bound the recessed internal portion of the opening.

8. The pile of claim 1, wherein the plinth has a cylindrical or conical shape with a circular or semi-circular cross-section and extends in an elongated manner orthogonally away from the pre-cast slab underside.

9. The pile of claim 1, wherein the pile has a shear strength of at least 30 kN.

10. The pile of claim 1, wherein the pile is generally circular in cross-section, a diameter of the pile designed to ensure bearing demand of the ground as being less than 500 kPa ultimate.

11. A pile comprising an elongated shape and configured, at one end, to fit at least partly into ground and, at the opposing end, comprising a shape that is configured to be received into an opening in a plinth, a size and shape of the plinth opening corresponding to the opposing end of the pile, the plinth extending from a pre-cast slab and the plinth, acting to locate and retain the pre-cast slab and plinth in place relative to the opposing end of the pile, and further comprising an insulating layer located between the plinth and the pile, the insulating layer configured to provide a thermal break between the plinth and the pile.

12. The pile of claim 11, wherein the size of the opening in the plinth is greater than the size of the opposing end of the pile disposed in the opening of the plinth to allow movement of the pile relative to the plinth.

13. The pile of claim 11, wherein the opening in the plinth is sized with sufficient tolerance to allow a pile opposing end to slide, at least to some extent within the opening before reaching a boundary to the opening area.

14. The pile of claim 11, wherein wall or walls extend from about the opening that at least in part bound the recessed internal portion of the opening.

15. The pile of claim 11, wherein the plinth has a cylindrical or conical shape with a circular or semi-circular cross-section and extends in an elongated manner orthogonally away from the pre-cast slab underside.

16. The pile of claim 11, wherein the pile has a shear strength of at least 30 kN.

17. The pile of claim 11, wherein the pile is generally circular in cross-section, a diameter of the pile designed to ensure bearing demand of the ground as being less than 500 kPa ultimate.

* * * * *